US010017345B2

(12) United States Patent
Franke et al.

(10) Patent No.: US 10,017,345 B2
(45) Date of Patent: Jul. 10, 2018

(54) DEVICE FOR CUTTING FILM-LIKE MEDIA

(71) Applicant: NEPATA GMBH, Wolnzach (DE)

(72) Inventors: Fabian Franke, Pfaffenhofen (DE); Stefan Baur, Pfaffenhofen (DE); Robert Schmidt, Miesbach (DE); Berhard Schmidt, Poernbach (DE)

(73) Assignee: NEPATA GmbH, Wolnzach (DE)

( * ) Notice: Subject to any disclaimer, the term of this patent is extended or adjusted under 35 U.S.C. 154(b) by 242 days.

(21) Appl. No.: 14/884,688

(22) Filed: Oct. 15, 2015

(65) Prior Publication Data

US 2017/0107070 A1 Apr. 20, 2017

(51) Int. Cl.
*B65H 20/02* (2006.01)
*B65H 18/10* (2006.01)

(52) U.S. Cl.
CPC ..... *B65H 18/103* (2013.01); *B65H 20/02* (2013.01); *B65H 2301/4148* (2013.01); *B65H 2404/1441* (2013.01); *B65H 2511/11* (2013.01); *B65H 2511/114* (2013.01); *B65H 2511/51* (2013.01)

(58) Field of Classification Search
CPC ..... B65H 18/103; B65H 20/02
See application file for complete search history.

(56) References Cited

U.S. PATENT DOCUMENTS 9,579,910 B2 * 2/2017 Mukaiyama ..... B65H 23/048
9,758,332 B2 * 9/2017 Uruma ..... B65H 18/103
2015/0352864 A1 * 12/2015 Tanaka ..... B41J 11/008 347/104

FOREIGN PATENT DOCUMENTS

DE 3434253 A1 3/1986
DE 202010012238 U1 12/2011
DE 202013104247 U1 11/2013
EP 2426074 A2 3/2012
JP 2015013587 * 1/2015 ..... B65H 23/048

OTHER PUBLICATIONS

Nepata GmbH, "Rewind.Trim.Slit. Equipment for Efficient Foil Conversion" Available as early as Jun. 29, 2015, 16 pages.

* cited by examiner

*Primary Examiner* — Sang K Kim
(74) *Attorney, Agent, or Firm* — McCoy Russell LLP

(57) ABSTRACT

Methods and systems are provided for rewinding and cutting a film-like material. In one example, a method may include adjusting a position of a retractable driven shaft located between a first roller from which the film-like material is unwound and a second roller onto which the film-like material is rewound during the rewinding and cutting operations. The method may further include adjusting a tension applied on the film-like material based on speeds of a first shaft holding the first roller and a second shaft holding the second roller, and a brake force applied onto the first shaft.

18 Claims, 20 Drawing Sheets

DEVICE FOR CUTTING FILM-LIKE MEDIA

FIELD

The present description relates generally to methods and systems for controlling a device to rewind and cut a material.

BACKGROUND/SUMMARY

In a supply chain of sign-making industry, moving a product from manufacturer to end customer involves rewinding and/or cutting of films or film-like material at different stages of the supply chain based on customer's needs. For example, poly-vinyl films may be rewound to one or more rolls of one or more desired lengths from a master roll, or one or more sheets may be cut out from the master roll. Further, a rewound roll or a master roll may be slit into two or more rolls of desired width. As such, the measuring, rewinding, cutting and slitting operations may be performed by user-operated rewinding machines.

During rewinding a roll from a master roll, a tension applied on the moving film or film-like material may be adjusted in order to provide a higher quality product. Further, tight tension control measures provide greater throughput. For example, if tension is not adjusted appropriately, wrinkles may form within the film resulting in wasted or defective product. Inadequate tension adjustment may also result in the outer layers of the roll crushing the inner layers and/or the inner layers may telescope out, either of which may render the roll unusable.

The inventors herein have recognized the above-mentioned issues. Accordingly, in one example, the issues described above may be addressed by a method for a winding device, comprising: transporting a rolled film-like media from a first roller mounted on a first lower shaft to a second roller mounted on a second upper shaft via a third middle shaft, the third middle shaft in a first position; and responsive to initiation of rewinding of the film-like media onto the second roller, adjusting the third shaft to a second different position. In this way, by retracting the middle shaft during the rewinding process, tension control may be improved.

As one example, during up-take of the film into a transportation head of the winding device, the middle shaft may be operated in a first position making contact with the material. By making contact with the film, the middle shaft facilitates feeding of the film through the transportation head, edge detection and initiation of measurement of the length of the film from the edge. However, during rewinding of the film, after the feeding, edge detection and initiation of measurement, the middle shaft may be retracted away from the film to a second retracted position. When operating in the second retracted position, the middle shaft is not in contact with the film, thus reducing the need for synchronization of the upper, middle, and lower shaft speeds during the rewinding operation. This provides greater control with tension adjustment as fewer parameters need to be adjusted while achieving proper uptake of the film into the transportation head and referencing of the film.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1, 2A, 2B, 3, 4, 8A and 9 are shown approximately to scale.

DETAILED DESCRIPTION

Figure 1:
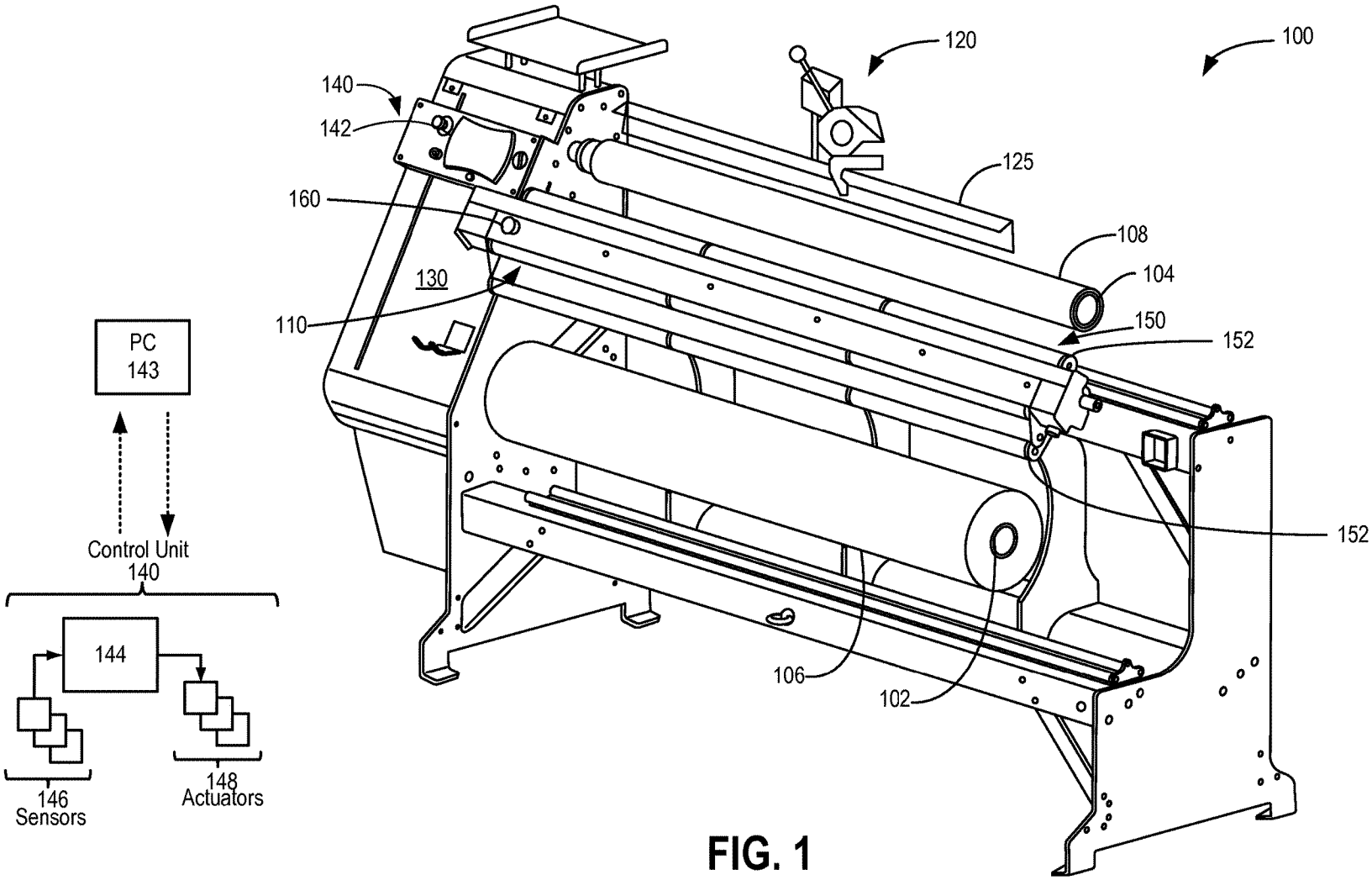
FIG. 1 is a front perspective view of a winding device including a cutting device and a slitting device.
Figure 10:
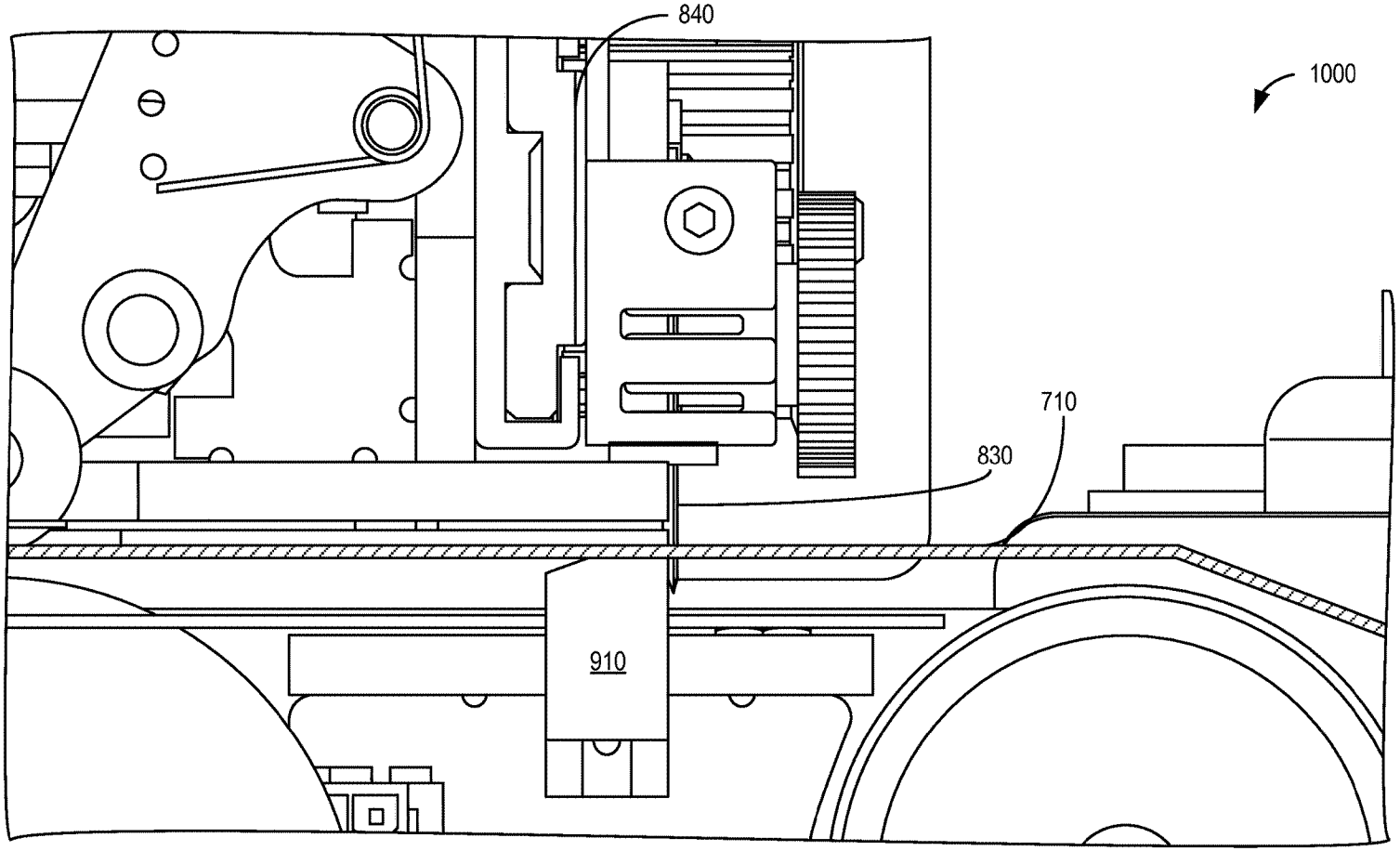
FIG. 10 is a schematic view of a portion of the cutting device of FIG. 1 illustrating a position of a cross-cutting blade and the material for rewinding.
Figure 11:
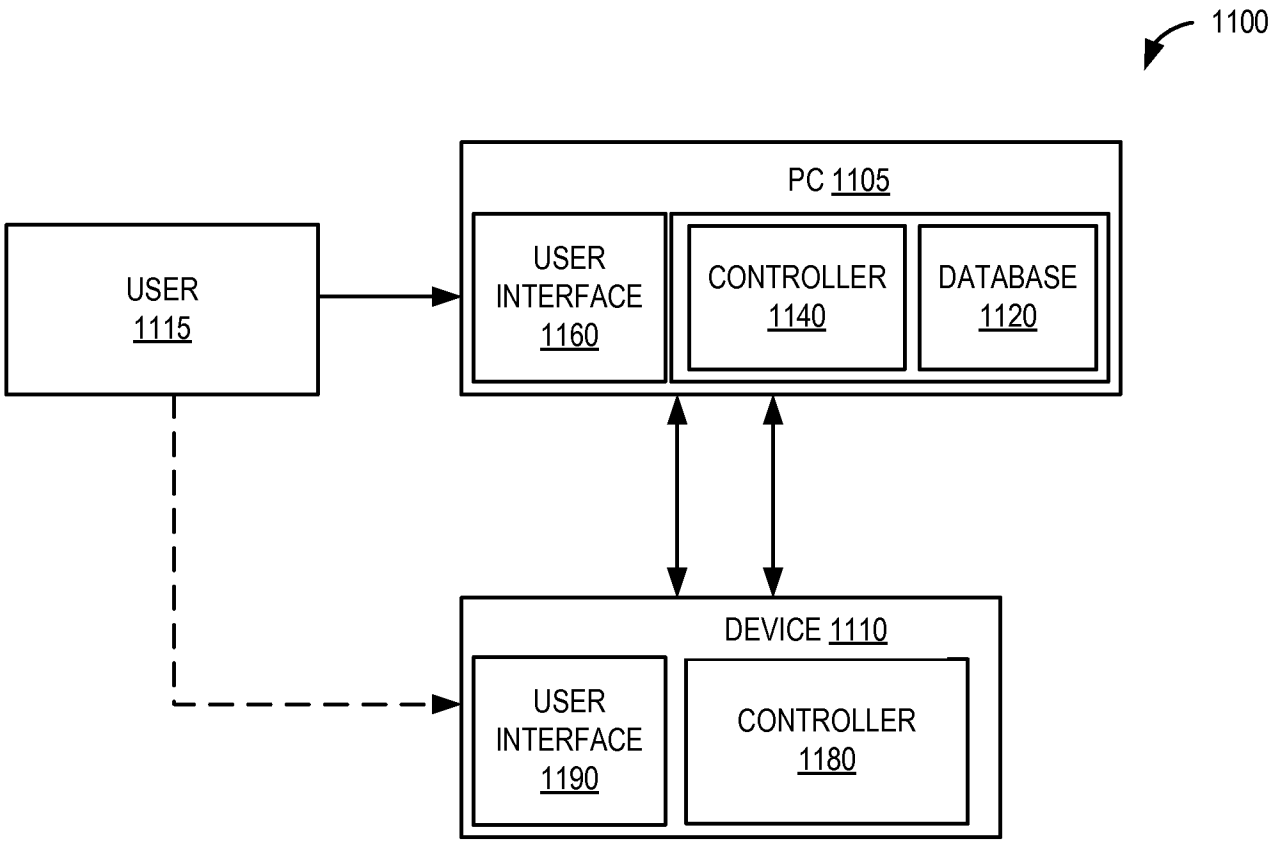
FIG. 11 is a block diagram illustrating an example interaction between a user, a personal computer coupled to the winding device of FIG. 1, and an internal controller of the winding device.

The following description relates to systems and methods for measuring, rewinding, and cutting a film or film-like material by utilizing a winding device, such as winding device 100 of FIG. 1. The systems and methods described herein may also be applied to an embodiment of winding device 100 shown in FIG. 2A. The winding device may include a driven adjustable pre-feeding shaft, shown in FIGS. 2B, and 3-7, between a first lower shaft and a second upper shaft. By adjusting a speed and position of the pre-feeding shaft, a tension of the film or film-like material that is rewound onto a roll mounted on the second upper shaft may be adjusted with increased precision and speed. Further, the winding device includes a cutting device such as cutting device 110 shown at FIGS. 1, 8A, 8B, 9 and 10 for performing a cutting operation. The winding device may be coupled to a personal computer for receiving user input. The PC may include a first controller, which may be configured to perform a control routine, such as the routine of FIG. 12, for receiving user input and sending values for one or more process parameters for an operation of the winding device to a second controller. The second controller may be configured to perform a control routine, such as routines shown in FIGS. 13-16 for performing the operation. An example interaction between the user, the PC and the device is illustrated at FIG. 11. An example operating sequence of the winding device is shown in FIG. 17.

FIG. 1 is a front perspective view of a winding device 100 including a cutting device 110 and a slitting device 120. Winding device 100 further includes a first shaft 102 on which a first roll 106 is mounted, and a second shaft 104 on which a second roll 108 is mounted. First roll 106 may be a master roll from which a rolled film or film-like material (herein referred to as material or film or film-like material interchangeably) may be at least partially unwound during a rewinding process. Specifically, during the rewinding process, as explained further herein with respect to FIGS. 12-17, the film may be at least partially unwound from first roll 106 and rewound onto second roll 108.

Each of first shaft 102 and second shaft 104 may include one or more clamping drums (not shown) and one or more adjustable cylinders (not shown) for fixing first roll 106 and second roll 108 on first shaft 102 and second shaft 104 respectively. In one example, one end of second shaft 104 may be coupled to a handle to enable a pivoting movement of second shaft 104 by a user operating the handle for loading and unloading second roll 108 onto second shaft 104. An embodiment of winding device 100 including one or more clamping drums for loading and positioning first roll 106 and second roll 108 on the winding machine is shown at FIG. 2A.

First shaft 102 is driven by a first motor located within a drive unit 130 of the winding machine, and second shaft 104 is driven by a second motor within drive unit 130. Details of drive unit 130 including the first motor, and the second motor are further described with respect to an embodiment of winding device 100 shown at FIG. 2A.

Figure 2A:
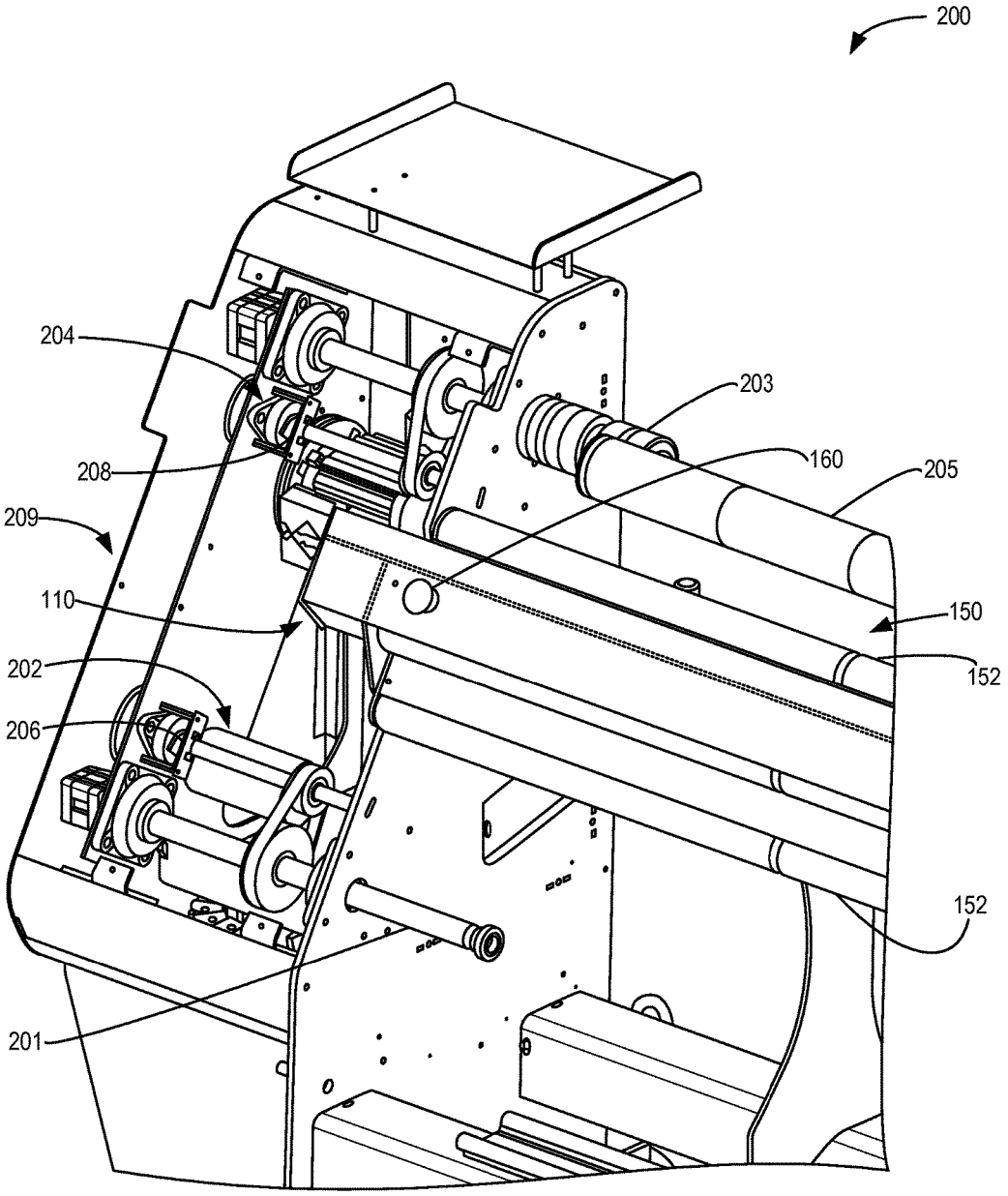
FIG. 2A is an enlarged front perspective view of an embodiment of the winding device of FIG. 1 including a drive unit.

Turning to FIG. 2A, a second embodiment of winding device 100 is illustrated. Specifically, FIG. 2A shows a portion 200 including a first drum 201, a second drum 203, a receptacle 205, and a drive unit 209. It will be appreciated that the configuration described with respect to FIG. 2A may be utilized in combination with other system configurations described herein.

While the present example shows only one first drum 201, another first drum (not shown) may be positioned opposite to the first drum such that a first roll, such as first roll 106 at FIG. 1, of a film or film-like material may be loaded onto the winding device and adjusted by utilizing both the first drums. In other words, a first receptacle may comprise first drum 201 and another first drum, and the first roll of the film-like material may be loaded onto the winding device by utilizing the first receptacle. In one example, one or both the first drums may be movable for adjusting a position of the first roll based to a diameter of the material of the first roll.

Second drum 203 may be utilized for loading a second roll, such as second roll 108 at FIG. 1, onto the winding machine. Receptacle 205 may be pivotable via a handle (not shown) with respect to second drum 203. Second drum 203 and/or receptacle 205 may be utilized to adjust a position of the second roll based on a diameter of the second roll.

Drive unit 209 includes a first motor 202 driving first drum 201 and a second motor 204 driving second drum 203. As indicated previously, drive unit 209 may be configured to be utilized with any winding device, such as winding device 100 at FIG. 1. For example, drive unit 209 and drive unit 130 may be configured to perform similar functions. Thus, in one embodiment, first motor 202 may drive a first shaft, such as first shaft 102 at FIG. 1, and second motor 204 may drive a second shaft, such as second shaft 104 at FIG. 1.

Drive unit 209 further includes first speed sensor 206 for estimating a rotational speed of first drum 201 and a second speed sensor 208 for estimating a rotational speed of second drum 203. In another embodiment, first speed sensor 206 may be utilized for estimating a rotational speed of the first shaft, and second speed sensor 208 may be utilized for estimating a rotational speed of the second shaft. First motor 202 may be an electric motor, such as a DC motor. Similarly, second motor 204 may be an electric motor, such as a DC motor. In some examples, the first motor and/or the second motor may be a stepper motor or a servo motor.

Further, braking of first drum 201 may be provided by first motor 202 itself or a first braking system. Likewise, braking of second drum 203 may be provided by second motor 204 or a second braking system. In another embodiment, braking of the first shaft may be provided by first motor 202 itself or the first braking system; and braking of the second shaft may be provided by second motor 204 or the second braking system. The first and/or the second braking system may be a DC braking system, for example.

During the rewinding process, a rotational speed of first drum 201 may be adjusted by first motor 202 and/or the first braking system, and a rotational speed of second drum 203 may be adjusted by second motor 204 and/or the second braking system. Further, during the rewinding process, a tension applied onto the material may be adjusted by the speed and/or braking force applied to first drum 201 and the speed of the second drum 203. In some examples, the tension may be adjusted by the speed and/or braking force applied to the first and the second drums.

In another embodiment, during the rewinding process, a rotational speed of the first shaft may be adjusted by first motor 202 and/or the first braking system, and a rotational speed of the second shaft may be adjusted by second motor 204 and/or the second braking system. Further, during the rewinding process, the tension applied onto the material may be adjusted by the speed and/or braking force applied to the first shaft and the speed of the second shaft. In some examples, the tension may be adjusted by the speed and/or braking force applied to the first and the second shafts. Returning to FIG. 1, winding device 100 further includes a transportation head 150 comprising one or more idlers 152, a metal sheet, a pre-feeding shaft module, and a length sensor. A portion of the winding device including transportation head 150 is shown in FIG. 2B.

Figure 2B:
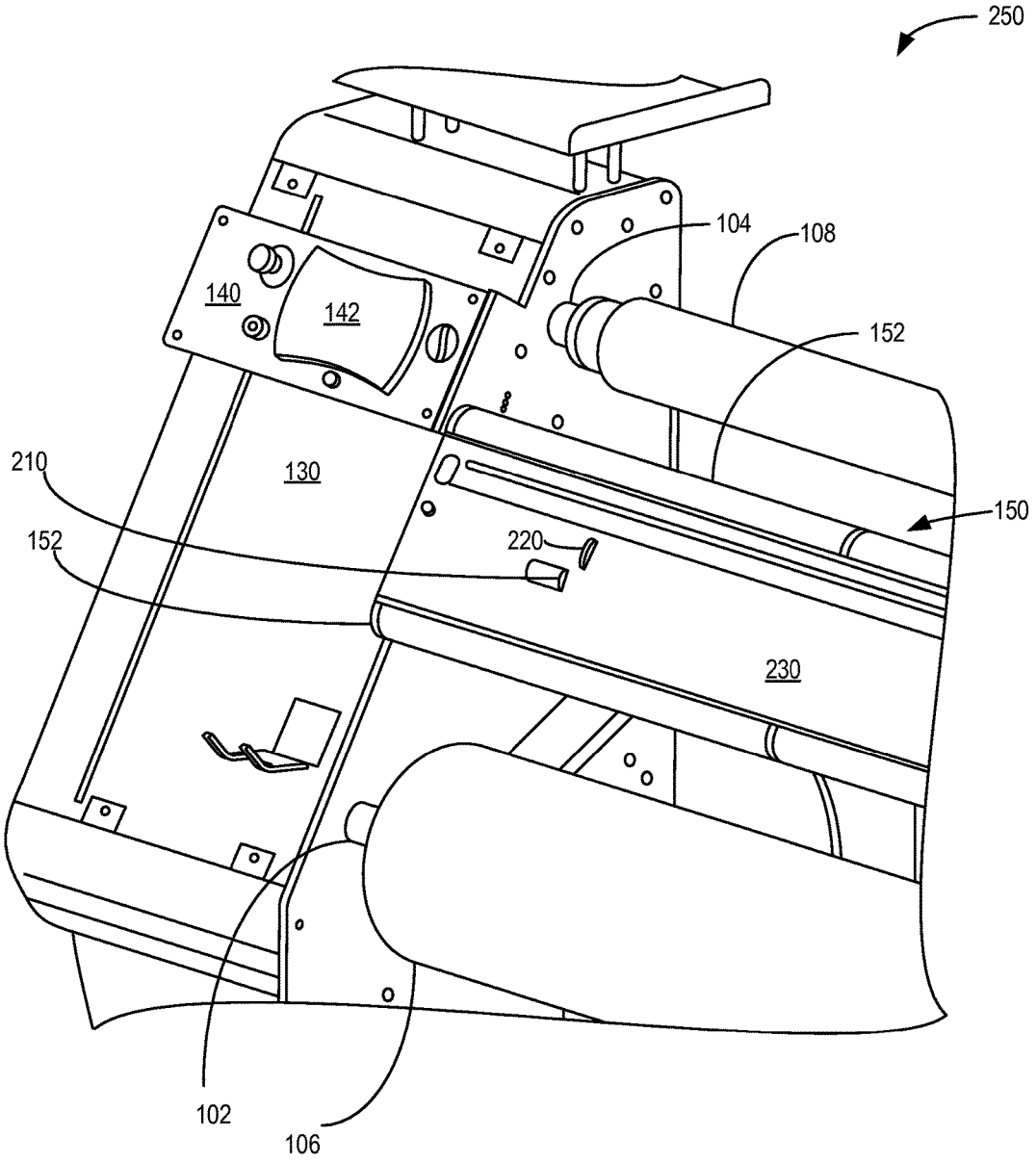
FIG. 2B is an enlarged front perspective view of a portion of the winding device of FIG. 1 showing a pre-feeding shaft within a transportation head of the winding device.

Turning to FIG. 2B, it shows an enlarged perspective view of a portion 250 of the winding device. In particular, portion 250 shows transportation head 150 without cutting device 110 mounted on transportation head 150.

Transportation head 150 includes metal sheet 230 on which the film-like material slides during the rewinding process, and one or more idlers 152 for facilitating transportation of the film-like material. Transportation head 150 further includes a pre-feeding shaft module (not shown) arranged below sheet metal 230. Portions of the pre-feeding shaft module may protrude through sheet metal. Specifically, the pre-feeding shaft module includes a pre-feeding shaft 210 and a length sensor 220, both of which protrude through openings in metal sheet 230. Further, a length of pre-feeding shaft may be less than a length of the transportation head. That is, pre-feeding shaft occupies a portion of the transportation head and does not extend fully across the length of the transportation head.

Pre-feeding shaft 210 is utilized during an initial phase of a rewinding operation, such as during insertion of the film-like material into transportation head 150, detection of the film-like material, and initial measurement of a length of the film-like material. Further, the pre-feeding shaft is utilized during a later phase of the rewinding operation, such as when a remaining length of rewinding of the film-like material is less than threshold, and during a cutting operation. Accordingly, during certain phases of rewinding operation, such as during the initial phase and during the later phase, pre-feeding shaft 210 protruding through metal sheet 230 may make direct contact with the film-like material. A position of pre-feeding shaft 210 may be adjusted by a retraction motor (shown at least at FIG. 3) included within the pre-feeding shaft module to make direct contact with the film-like material. However, during a rewinding phase between the initial and later phases of the rewinding operation, pre-feeding shaft 210 may be adjusted by the retraction motor to break direct contact with the film in order to provide better tension control of the film during the rewinding phase. Thus, pre-feeding shaft 210 may be adjusted to multiple different positions by the retraction motor. Further, a third motor (shown at least at FIG. 3) within the pre-feeding shaft module may adjust a speed of pre-feeding shaft 210.

Length sensor 220 is utilized to measure a rewinding length of the film-like material. Length sensor 220 may be a measuring wheel, for example. In the given example, a position of length sensor 220 is not adjustable, and length sensor 220 may be positioned to make continuous direct contact with the film-like material sliding on metal sheet 230 during all operations of the winding device. That is, length sensor 220 may be in direct contact with the material during the initial, the rewinding and the later phases of the rewinding process, and during the cutting and slitting operations. In some examples, the position of length sensor 220 may be adjustable. For example, upon completion of measurement of the film-like material, the length sensor may be adjusted to break contact with the film during the cutting and/or slitting process. While the given example shows a length sensor that is in contact with the film-like material, it will be appreciated that other types of length sensors, such as a laser based non-contact length sensor, may be utilized.

Further details of the pre-feeding shaft module including pre-feeding shaft 210, length sensor 220, the third motor, and the retraction motor is discussed at FIGS. 3 and 4 below.

Figure 3:
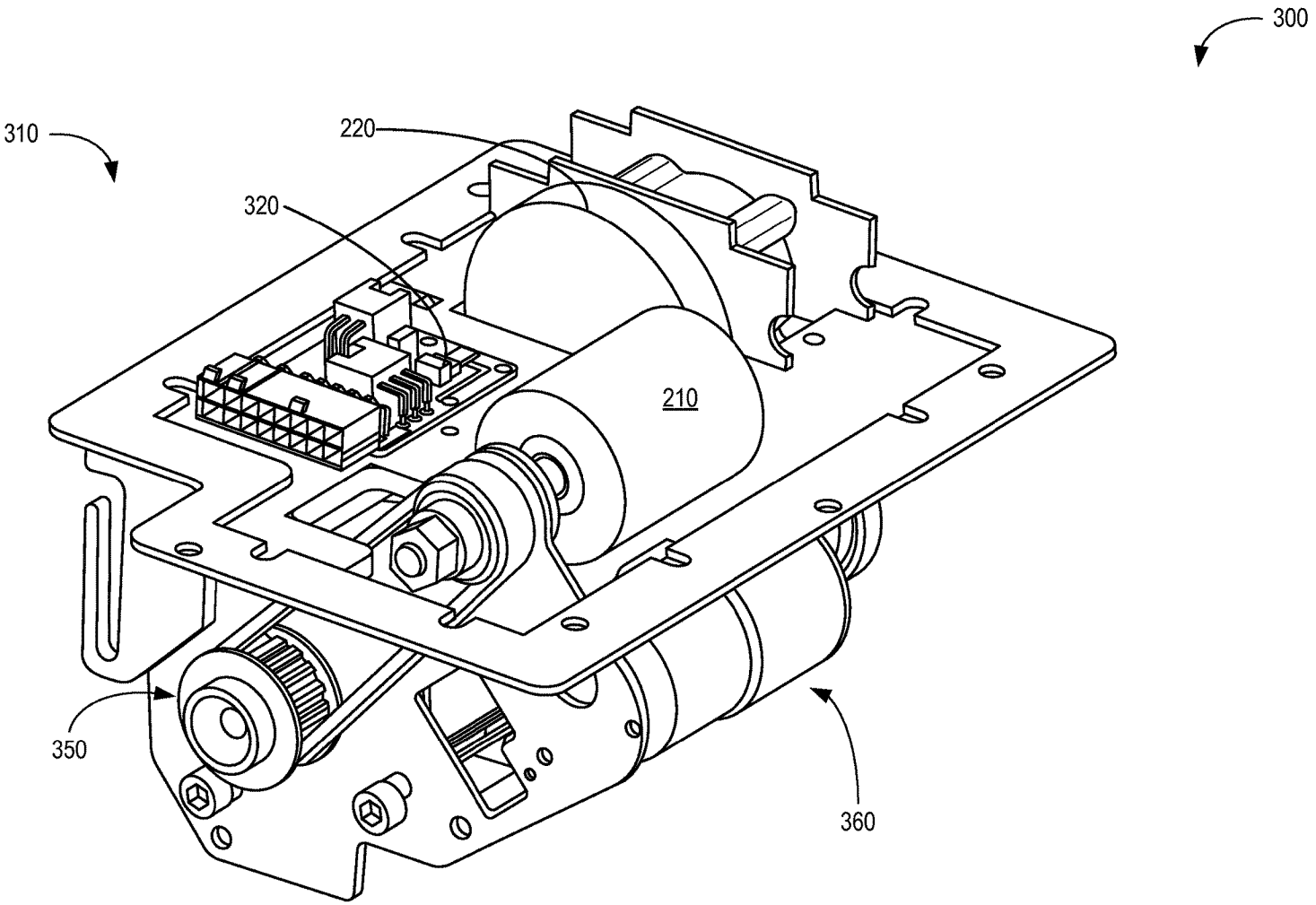
FIG. 3 is a first perspective view of a portion of the winding device of FIG. 1 including a pre-feeding shaft module.
Figure 4:
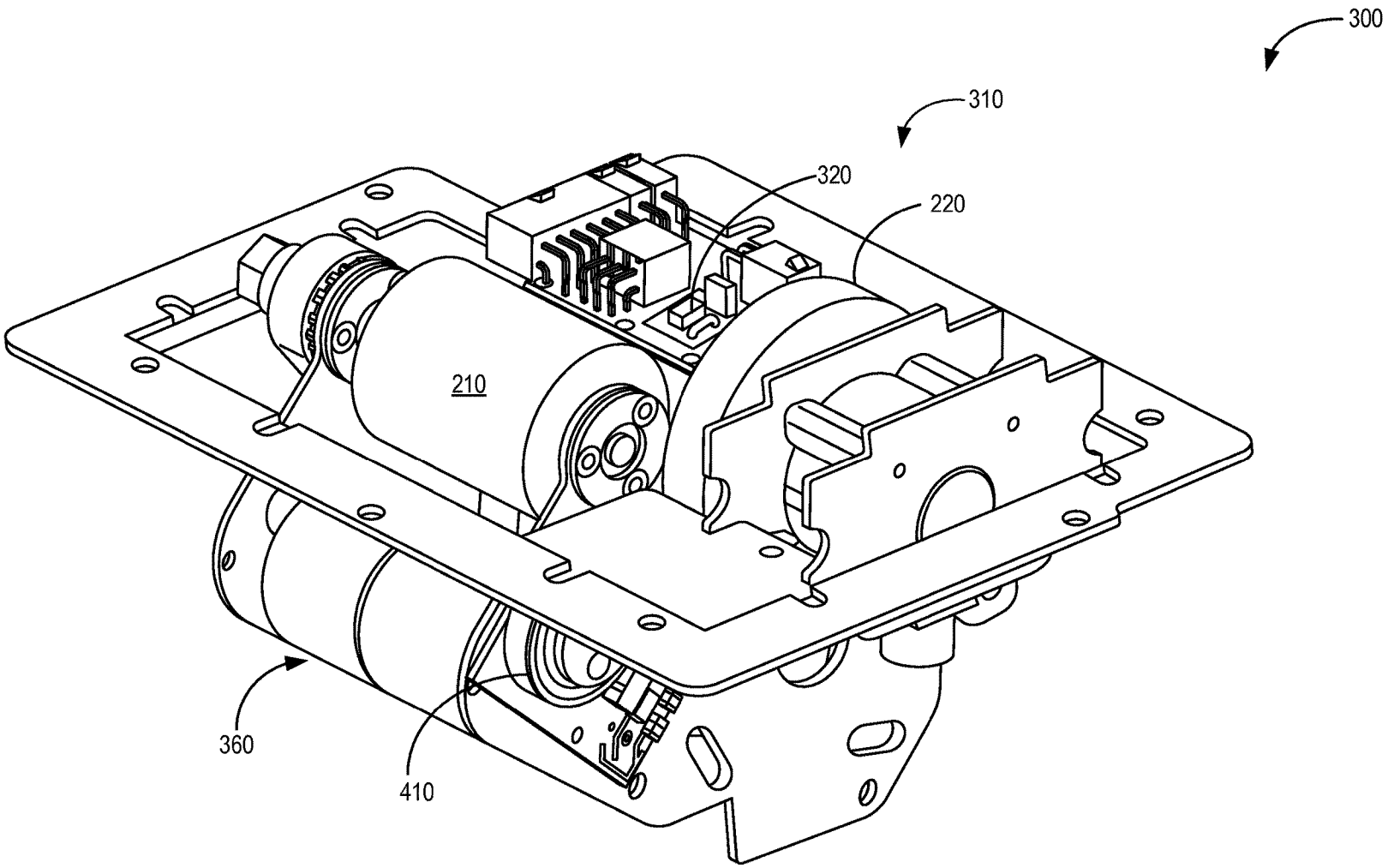
FIG. 4 is a second perspective view of a portion of the winding device of FIG. 1 including the pre-feeding shaft module.

Turning to FIG. 3, a first perspective view of a portion 300 of winding machine 100 including a pre-feeding shaft module 310 is illustrated. Specifically, a front left perspective view is shown.

Pre-feeding shaft module 310 includes pre-feeding shaft 210, a motor 350 for adjusting a speed of pre-feeding shaft 210, a motor 360 for adjusting a position of pre-feeding shaft 210, length sensor 220, and an optical sensor 320. In one example, pre-feeding shaft 210 may be a rubber drum.

Motor 350 may be a stepper motor, for example. Motor 360 may be a refraction motor including an eccentric wheel 410, as shown in the second (right front) perspective view of portion 300 in FIG. 4. Motor 360 may be utilized for providing linear movement of pre-feeding shaft 210. Thus, by utilizing the retraction motor, the pre-feeding shaft may be adjusted during the rewinding operation.

For example, pre-feeding shaft may be adjustable between a first contact position, at which position pre-feeding shaft 210 is in direct contact with the film-like material and a second retracted position, at which position pre-feeding shaft 210 is not in direct contact with the film-like material. That is, position of pre-feeding shaft 210 may be adjusted to the first position to make and/or maintain direct contact with the film-like material during loading of the film-like material onto transportation head 150, detection of the film-like material, and an initial measurement of a length of the film-like material. Upon completion of the initial measurement, during rewinding of the film-like material, pre-feeding shaft may be adjusted (that is, retracted) to the second position to break direct contact with the film. Subsequently, towards the end of the rewinding process (e.g., when the remaining rewinding length is less than a threshold length), pre-feeding shaft 210 may be adjusted to the first position or a third contact position, to make direct contact with the film and the direct contact may be maintained until the rewinding is completed. In one example, the third contact position may be different from the first contact position. For example, the third contact position may be based on a desired tension of the film. Therefore, the third contact position may provide greater or lesser force than the first contact position based on the desired tension. Further, in some examples, pre-feeding shaft 210 may make direct contact until a cutting and/or slitting of the film-like material is completed. An example of a first contact position of the pre-feeding shaft is described with respect to FIG. 5; and an example of a second retracted position of the pre-feeding shaft is described with respect to FIG. 6.

Further, the position of pre-feeding shaft 210 may be adjustable between multiple different positions. For example, in order to control a force applied by pre-feeding shaft 210 on the film-like material and thereby, control a slippage between pre-feeding shaft 210 and the film-like material, the position of pre-feeding shaft 210 may be adjusted by motor 360. That is, the position of pre-feeding shaft may be infinitely variable and may be adjusted to control the force applied by the pre-feeding shaft on the film-like material. As an example, during the initial phase of rewinding process, in order to facilitate loading of the film-like material onto transportation head 150, the position of pre-feeding shaft may be adjusted via motor 360. For example, in order to reduce slippage between pre-feeding shaft 210 and the film-like material, position of pre-feeding shaft may be adjusted to increase force applied by pre-feeding shaft on to the film-like material while making and/or maintaining direct contact with the film-like material.

Further, an amount of force applied by pre-feeding shaft 210 onto the film-like material, and therefore the position of pre-feeding shaft may be based on one or more properties of the film-like material, such as a thickness of the film-like material, a smoothness of the film-like material, etc. In some examples, depending on the one or more properties of the film, the position of pre-feeding shaft 210 may be adjusted in order to provide a desired force for uptake of the film-like material, edge detection and initial measurement. Thus, based on a type of the film-like material, the first contact position of pre-feeding shaft may vary. Details of adjustment of pre-feeding shaft position will be further elaborated with respect to FIGS. 14A, 14B, and 17.

Optical sensor 220 may be utilized to detect an edge of the film-like material. For example, light from a light source positioned opposite to optical sensor 220 (that is, the light source and optical sensor 220 positioned on opposite sides of the film-like material in the transportation head) may be applied onto transportation head 150. The absence or presence of the film-like material may be determined based on whether light from the light source is detected by the sensor or not. Further, in some examples, optical sensor 220 may be utilized to detect a leading edge of the film-like material, based on a change in absorption pattern of the light received by the sensor, for example.

Figure 5:
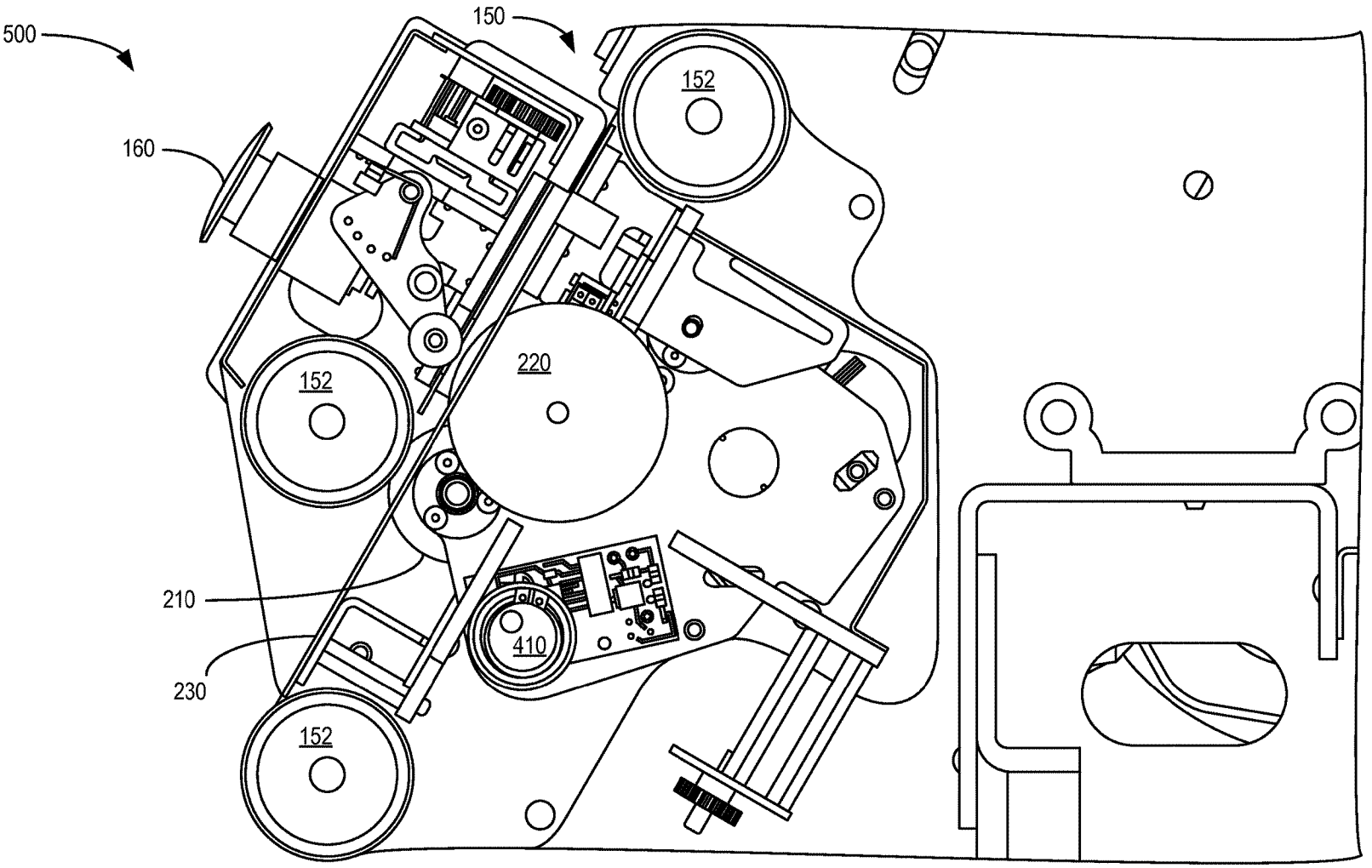
FIG. 5 is a schematic view of a portion of the winding device of FIG. 1 including the pre-feeding shaft in a forward contact position.

Turning now to FIG. 5, a portion 500 of winding device 100 including pre-feeding shaft 210 in a first contact position making contact with the film-like material within transportation head 150 is shown. Pre-feeding shaft 210 is adjusted to the first contact position by the retraction motor. The movement of pre-feeding shaft is facilitated by eccentric wheel 410.

During an initial phase of the rewinding operation, such as during insertion of the film-like material into transportation head 150, detection of a leading edge of the film-like material, and initial measurement of a length of the film-like material from the detected edge, pre-feeding shaft 210 may be adjusted to the first contact position by the retraction motor. When operating in the first contact position, pre-feeding shaft 210 is in direct contact with material 710. The first contact position facilitates uptake of the film-like material by transportation head 150, and subsequent edge detection and initial measurement. As mentioned above, the first contact position may vary based on a type of the film-like material including a thickness and smoothness of the film-like material. Further, in some examples, if the first contact position does not provide sufficient force for uptake of the film-like material onto transportation head 150, the position of pre-feeding shaft may be adjusted (moved forward towards the film-like material) from the first contact position while maintaining contact to provide sufficient force, thereby reducing slippage, for uptake of the film-like material. However, if the first contact position provides excessive force (therefore, more friction) which prevents uptake of the film-like material, pre-feeding shaft may be adjusted (retracted away from the film-like material) from the first position while maintaining contact to reduce force applied on the material and facilitate smoother uptake and transport of the film-like material.

During rewinding after the film-like material is attached to the second roll mounted on the second shaft, pre-feeding shaft 210 may be adjusted to the second retracted position by the retraction motor. For example, the film-like material may be attached onto second roll by an operator by a tape, and the attachment may be indicated by the operator by actuating switch 160. The actuation of switch 160 after attachment of the film onto the second shaft may also initiate the rewinding process by increasing a speed of the second shaft. Therefore, in one example, pre-feeding shaft may be adjusted to the second position responsive to the speed of the second shaft increasing above a threshold speed, which provides an indication that the rewinding is in progress.

Figure 6:
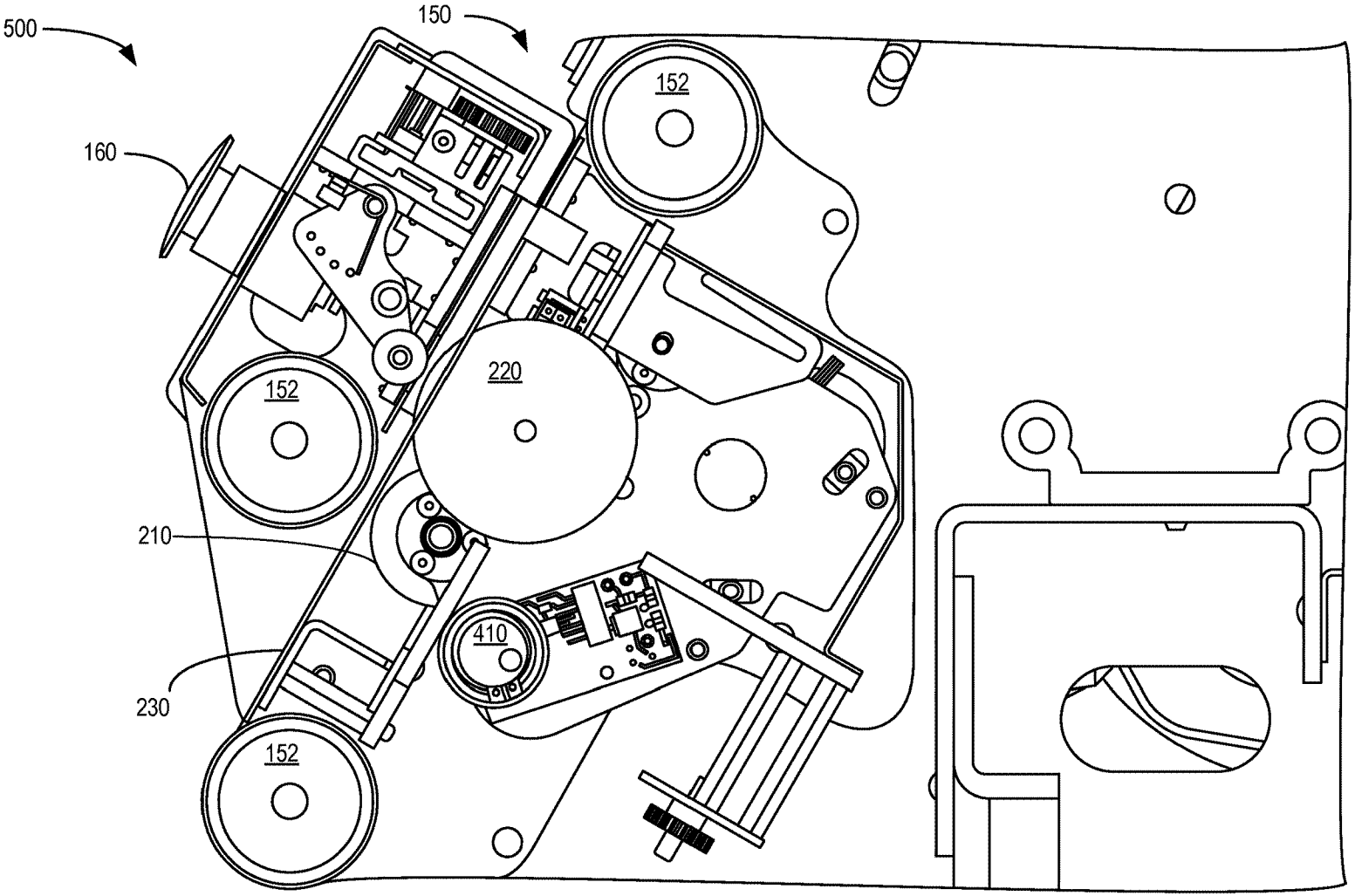
FIG. 6 is a schematic view of the portion of FIG. 5 of the winding device including the pre-feeding shaft in a retracted non-contact position.

Turning now to FIG. 6, it shows the portion 500 of winding device 100 including pre-feeding shaft 210 in the second retracted position relative to the film-like material within transportation head 150. When operating in the second retracted position, pre-feeding shaft 210 is set back from the material and does not make contact with the material. Further, when operating in the second retracted position, pre-feeding shaft 210 may not protrude through metal sheet 230. By adjusting the pre-feeding shaft to the second retracted position during the rewinding process, a tension applied to the material that is being unwound from first roll 106 and rewound onto second roll may be adjusted without synchronizing the pre-feeding shaft speed with the first shaft speed and the second shaft speed. Thus, more accurate and faster adjustment of tension may be achieved during the rewinding operation.

Further, towards the end of the rewinding process, when a remaining length of rewinding is less than a threshold length, pre-feeding shaft 210 may be moved to the first position shown in FIG. 5. In some examples, when the remaining length is less than the threshold length, pre-feeding shaft may be moved to a third position different from the first position. When operating in the third position, the pre-feeding shaft is in direct contact with the film-like material. However, a force applied by the pre-feeding shaft onto the material when operating in the third position may be different from the force applied by the pre-feeding shaft onto the material when operating in the first position. For example, the force applied by the pre-feeding shaft when operating in the third position may be less than the force applied by the pre-feeding shaft when operating in the first position.

Returning to FIG. 1, cutting device 110 is arranged above the transportation head 150. Cutting device 110 may be utilized for cutting the material after rewinding onto second roll 108 and/or for cutting a sheet of the material unrolled from first roll 106. Cutting device 110 includes two or more cutting blades positioned on a blade carriage, a linear guiding rail, and one or more motors for driving the cutting blades across the linear guiding rail. Details of cutting device 110 are further illustrated and described with respect to FIGS. 8A, 8B, 9, and 10.

Slitting device 120 is positioned on a linear guide 125 above second shaft 104. Slitting device 120 may be utilized to slit the material rolled onto second roll 108 into two or more multiple rolls of desired widths. Slitting device may also be utilized to slit a sheet of material to desired widths. Slitting device 120 includes at least one revolving blade, which may be engaged with second roll 108 during slitting. Slitting device 120 may move freely along liner guide 125. Thus, position of slitting device is adjustable on linear guide 125 by the operator. Further, slitting device 120 may be locked on the linear guide at a desired position prior to slitting and during the slitting operation.

A control unit 140 is included within winding device 100. Control unit 140 may be any electronic control system of winding device 100 and may include a controller, such as a programmable logic controller (PLC). Control unit 140 may be configured to make control decisions based at least partly on input from one or more sensors 146 within the winding device, and/or user input via a user interface 142 coupled to the winding device, and may control one or more actuators 148 of the winding device based on the control decisions. For example, control unit 140 may store computer-readable instructions in memory, and the one or more actuators may be controlled via execution of the instructions. Example sensors include optical sensor 320 (shown at FIGS. 3 and 4), length sensor 220 (shown at least at FIG. 2B), rotation speed sensors 206 and 208 (shown at FIG. 2B), one or more position sensors, and a brake current sensor, described herein with respect to FIGS. 2A, 2B, 3 and 4. Example actuators include motors 202 and 204 driving first and second shafts (shown at FIG. 2A), motor 350 driving pre-feeding shaft 210 (shown at least at FIG. 3), motor 360 adjusting pre-feeding shaft position (shown at least at FIG. 3), and one or more motors driving cutting device 110. Additional sensors and actuators may be included. Storage medium read-only memory in control unit 140 can be programmed with computer readable data representing instructions executable by a processor for performing the methods described below, as well as other variants that are anticipated but not specifically listed. Example methods and routines are described herein with reference to FIGS. 13-16.

Control unit 140 may include user interface 142 for allowing the user to request a winding operation and/or to specify one or more process parameters of a winding operation. One or more process parameters may include a target winding length, a winding speed, a desired tension, a number of rolls, desired width of rolls and/or sheets, etc. In one example, the user interface may be configured to prompt the user to perform one or more actions. For example, if the second roll is not mounted on the second shaft, control unit 140 may prompt the user via the user interface 142 to load the second shaft with the second roll.

In some embodiments, control unit 140 may communicate with a second controller 143, such as personal computer (PC) controller, coupled to winding device 100. In one example, controller 143 may be configured to make control decisions based at least partly on input from the user via a user interface of the PC, and may control one or more actuators of the winding device based on the control decisions. In another example, controller 143 may be configured to receive user input, and determine pre-processing values for the one or more process parameters. The pre-processing values may then be sent to the control unit 140 of the winding device, and the one or more actuators of the winding device may be controlled by control unit 140 based on the information received from controller 143. Controller 143 may store computer-readable instructions in memory. Storage medium read-only memory in controller 143 can be programmed with computer readable data representing instructions executable by a processor for performing the methods described below, as well as other variants that are anticipated but not specifically listed. Example methods and routines are described herein with reference to FIGS. 12-16.

An example block diagram 1100 illustrating an example interaction between a user 1115 of a device 1110, a controller 1140 coupled within a PC 1105 coupled to device 1110, and a controller 1130 within device 1110 is shown at FIG. 11. Device 1110 may be a winding device, such as winding device 100 shown at FIG. 1, controller 1140 may be a PC controller, such as controller 143 at FIG. 1, and controller 1130 may be a PLC, such as controller 144 at FIG. 1. The user may communicate with controller 1140 via a PC user interface 1160 to request an operation and/or input one or more parameters of the requested operation, such as desired length of roll, number of rolls, desired tension, etc. Additionally or alternatively, the user may communicate with controller 1130 via a user interface 1190 to request an operation of the device and/or input the one or more parameters of the requested operation. The requested operation may include a winding operation and may further include a cutting operation and/or a slitting operation. Winding operation may include rewinding a film or film-like material from a first roll onto a second roll to form a second roll of desired length. Cutting operation may include cutting the film-like material in order to separate the first roll from the second roll after rewinding. Slitting operation may include slitting a roll into two or more rolls of desired widths.

Next, based on the user input, controller 1140 and/or controller 1130 may determine pre-processing values for the one or more process parameters of the operation. The pre-processing values may be determined based on historical values of the process parameters stored in a database 1120 of PC 1105. In other words, the pre-processing values may be learned values based on historical values of previously completed operations of the device or one or more similar winding devices. The database may further store information about the device, jobs performed on the device, images etc. In the given example, the database resides within the PC controller. In some examples, the database may reside within a server located remotely from the PC controller.

The pre-processing values may be sent to the PLC via a wired communication or wireless communication. The PLC may then control one or more actuators, such as actuators 148 at FIG. 1, including motors driving first and second shafts, motor 350 driving pre-feeding shaft, motor 360 adjusting pre-feeding shaft position, motor 810 driving cutting device 110 etc., based on the pre-processing values. During the rewinding process, based on feedback from one or more sensors, such as optical sensor 320 shown at least at FIG. 3, length sensor 220 shown at least at FIG. 2B, one or more rotation speed sensors shown at FIG. 2A, one or more position sensors, the brake current sensor etc., the process parameters may be adjusted by controller 1140. Additionally or alternatively, user 1115 may adjust the process parameters via potentiometers, user interface 1160 and/or user interface 1190. Upon completion of the rewinding job, the adjusted values of the process parameters including the values of the user adjusted process parameters and the values of the process parameters adjusted based on feedback from the sensors, may be sent back to the PC controller and stored in the database. In this way, controller 1140 and/or controller 1180 may learn the process parameters for a given film-like material during a rewinding job. The learnt values of the process parameters may be utilized for determining pre-processing values of the process parameters during a subsequent rewinding job with similar materials. Details of an example method executed by the PC controller will be further elaborated with respect to FIG. 12, and details of example methods executed by the PLC will be further elaborated with respect to FIGS. 13-16.

While the above example illustrates determining pre-processing values using the PC controller and storing the historical and manually set values is a database of the PC, it will be appreciated that the determination of pre-processing values performed by the PLC based on a historical value database of the PLC.

Returning to FIG. 1, winding device 100 further includes a switch 160 positioned on a housing for cutting device 110. Switch 160 may be actuatable by an operator or a user of winding device to perform a desired operation. Switch 160 may drive multiple state outputs. For example, every press of the switch toggles the output to a different level and the transition from one output to another may be performed in a cyclic manner. Thus, the operator may actuate switch 160 for a first time to initiate a pre-feeding sequence including increasing a speed of the pre-feeding shaft to a pre-determined speed and moving the pre-feeding shaft to the first contact position for uptake of the material from first roll 106 into transportation head 150. Later on, upon attaching the leading edge of the material to second roll 108, the operator may actuate switch 160 for a second time to initiate a rewinding sequence including adjusting speeds of the first and second shafts, adjusting a brake force applied onto the material during rewinding, retracting the pre-feeding shaft to the second position, etc. Details of various stages of the rewinding operation including, pre-feeding, edge-detection, measuring, rewinding, cutting, and slitting will be further elaborated herein with respect to FIGS. 12-17.

Figure 7:
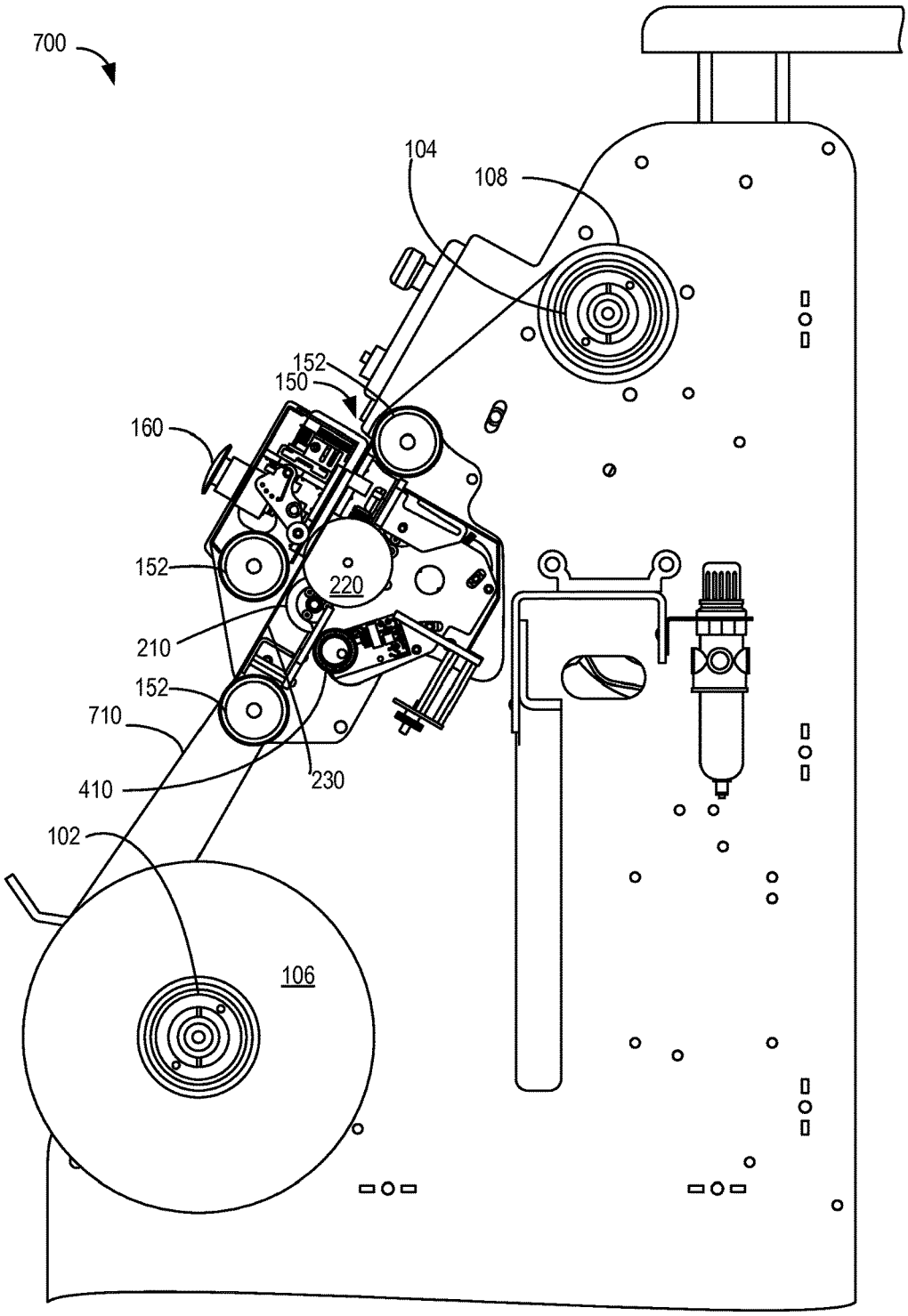
FIG. 7 is a schematic view of the winding machine of FIG. 1 showing positions of the pre-feeding shaft, a first lower shaft, and a second upper shaft.

Further, a schematic view of winding machine 100 including the film or film-like material is illustrated at FIG. 7. Specifically, FIG. 7 shows relative positions of first shaft 102, second shaft 104, pre-feeding shaft 210, and a film 710 during an operation of winding machine 100. Further FIG. 7 shows a length sensor 220.

As discussed above, length sensor 220 is positioned within transportation head 150. Length sensor 220 may be a measuring wheel, and the length of the material may be determined based on a number of revolutions of the measuring wheel. Further, as discussed above with respect to FIG. 3, an optical sensor is positioned within transportation head 150 and may be configured to detect light from a light source that applies light back and forth onto a shine-through light bar. The light source and optical sensor may be positioned on opposite sides of the material. Therefore, when the light is applied, if the optical sensor detects the presence of the source light (that is light from source reaches the sensor directly), it may be determined that the material is absent. However, if the optical sensor does not detect the presence of source light (that is light from source is absorbed by the material or properties of the light from the source are modified by the material), it may be determined that the material is present. Further, in some examples, the leading edge of the material may be detected based on a change in an absorption pattern of the light applied on the material.

Further, a brake current sensor may be within control unit 140 or drive unit 130 for sensing a brake current applied to first shaft 102. Based on a sensed brake current, a current brake force may be determined, and hence, a current tension acting on the material may be determined. Based on a difference between the current tension and a desired tension, braking applied to second shaft may be adjusted by the PLC. Thus, brake current sensor may be utilized for feedback control of tension during rewinding.

Figure 8A:
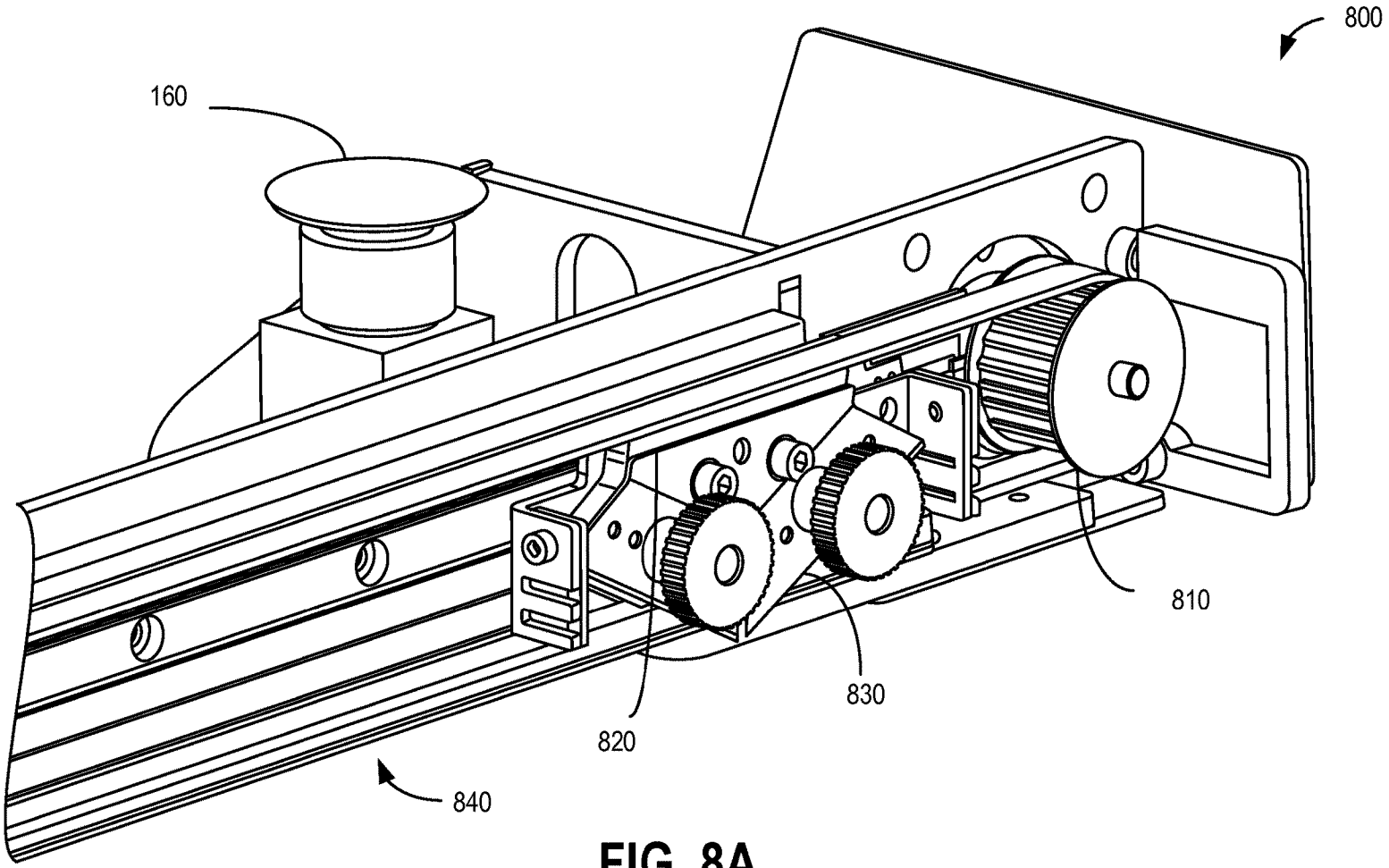
FIG. 8A is a first perspective view of a portion of the cutting device of FIG. 1 including a driving motor for the cutting device.
Figure 8B:
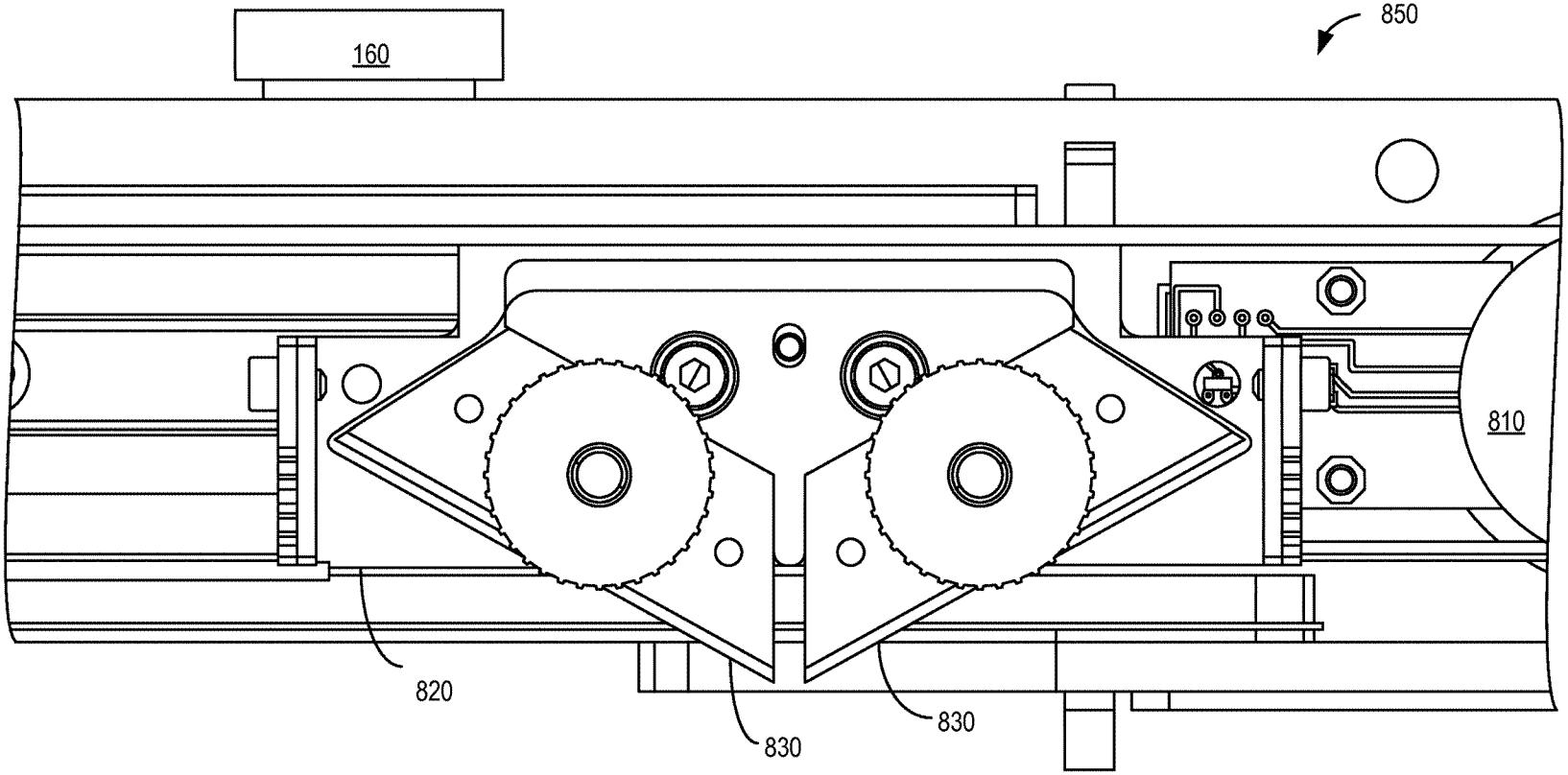
FIG. 8B is a schematic view of a portion of the cutting device of FIG. 1.

Turning to FIG. 8A, a back perspective view of a portion 800 of cutting device 110 is shown. Cutting device 110 includes a driving motor 810, a blade carriage 820 housing cross-cutting blades 830, and a linear guiding rail 840 across which blade carriage 820 travels to perform a cutting operation of the material after measuring and/or rewinding. While a single driving motor 810 is shown, more than one motor may be utilized. For example, cutting device 110 may include two driving motors, one or each side of the blade carriage 820. Driving motor 810 drives blade carriage 820 including blades 830. A schematic view 850 of blades 830 is shown in FIG. 8B. Blades 830 may be two-faced cutting blades, each cutting during movement of carriage in only one direction. For example, a first blade may cut the material when carriage 820 moves from a first position to a second position along linear guiding rail 840, and a second blade may cut the material when carriage 820 moves from the second position to first position. The movement of carriage 820 along linear guiding rail 840 may be determined based on speed of driving motor 810. If the driving motor speed is less than threshold, a strength of the signal delivered to driving motor may be increased by the PLC until the driving motor speed increases above the threshold. This value, that is the strength of the signal, may then be saved to the database for faster cutting of similar materials during future cutting operations. An example method illustrating a cutting operation is further described with respect to FIG. 16.

Figure 9:
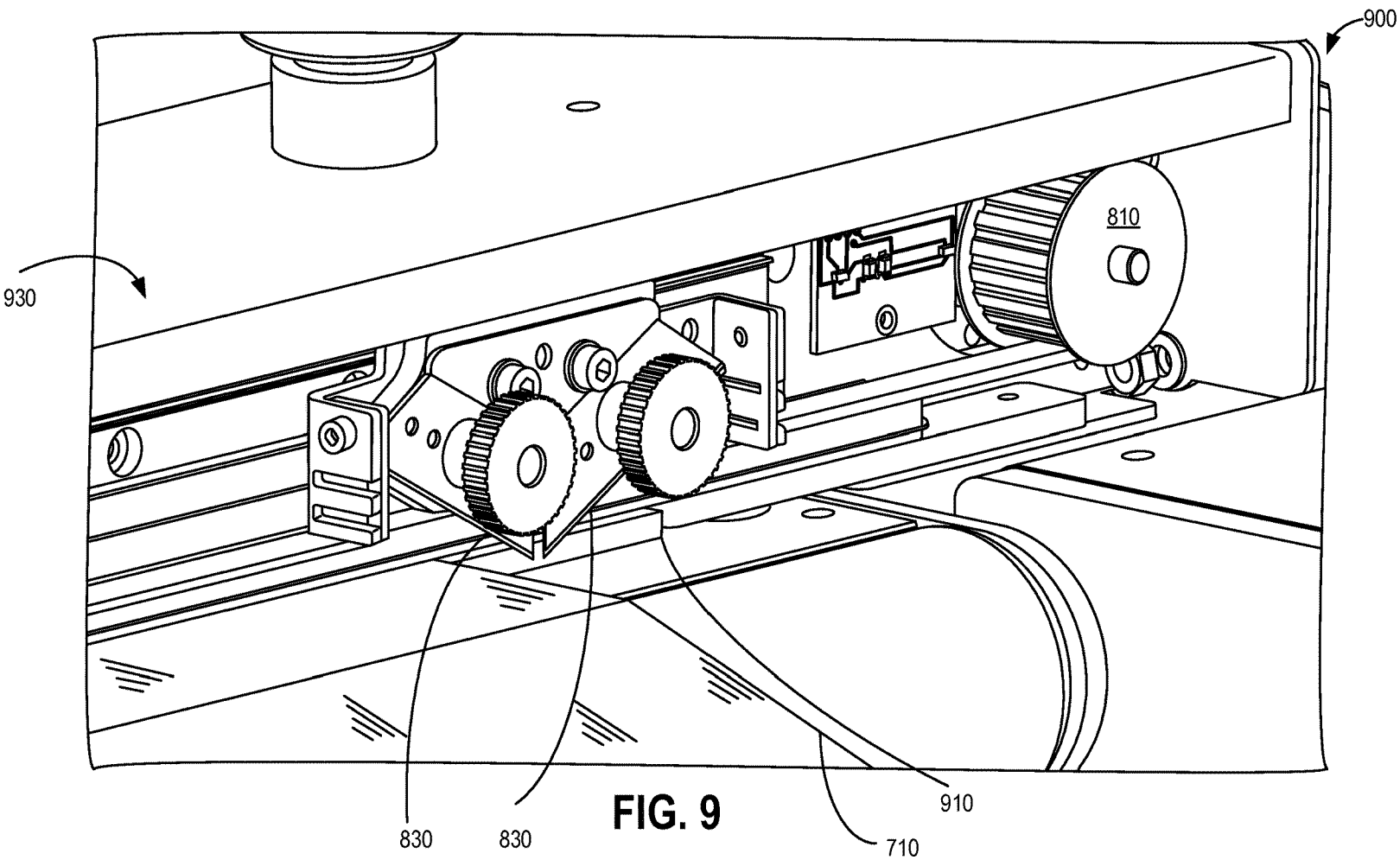
FIG. 9 is a second perspective view of a portion of the cutting device of FIG. 1 including a material for cutting.

FIG. 9 shows a second back perspective view of a portion 900 of a cutting device, such as cutting device 110 at FIG. 1, including material 710. Specifically, portion 900 includes blades 830 pressing against a cutting bar 910. Cutting bar 910 may be positioned below linear guiding rail 840 and may be separated by a distance from the linear guiding rail. Further, carriage 820 moves along cutting bar 910 and may be driven by motor 810. Just prior to a cutting operation, cutting bar 910 may be adjusted to a first position with respect to a cutting base plate. In the first position, cutting bar 910 may be in direct contact with the material and a cutting head 930 above. In other words, when in the first position, cutting bar 910 may press the material between bar 910 and a cutting head 930 above. During the cutting, the cutting bar may remain in the first position as blades 830 move along the cutting bar. After cutting, the cutting bar may be adjusted to a second position with respect to the cutting base plate. When in the second position, the cutting bar 910 may not be in direct contact with the material. For example, there may be a gap of 5 mm when cutting bar 910 is in the second position.

Movement of cutting bar 910 may be driven by one or more electromagnets that push the cutting bar forward (to the first position when the bar is in direct contact with the material, for example). The movement of cutting bar may be controlled via PLC. Further, cutting bar 910 may be pulled backwards via metal springs when the electromagnets are released. In this way, cutting bar 910 may provide support to the material during the cutting operation. A schematic view of cutting device 110 showing position of blades 830, linear guiding rail 840, carriage 820, cutting bar 910, and material 710 between carriage 820 and cutting bar 910 is illustrated at FIG. 10.

FIGS. 1, 2A, 2B, 3, 4, 8A and 9 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example.

Figure 12:
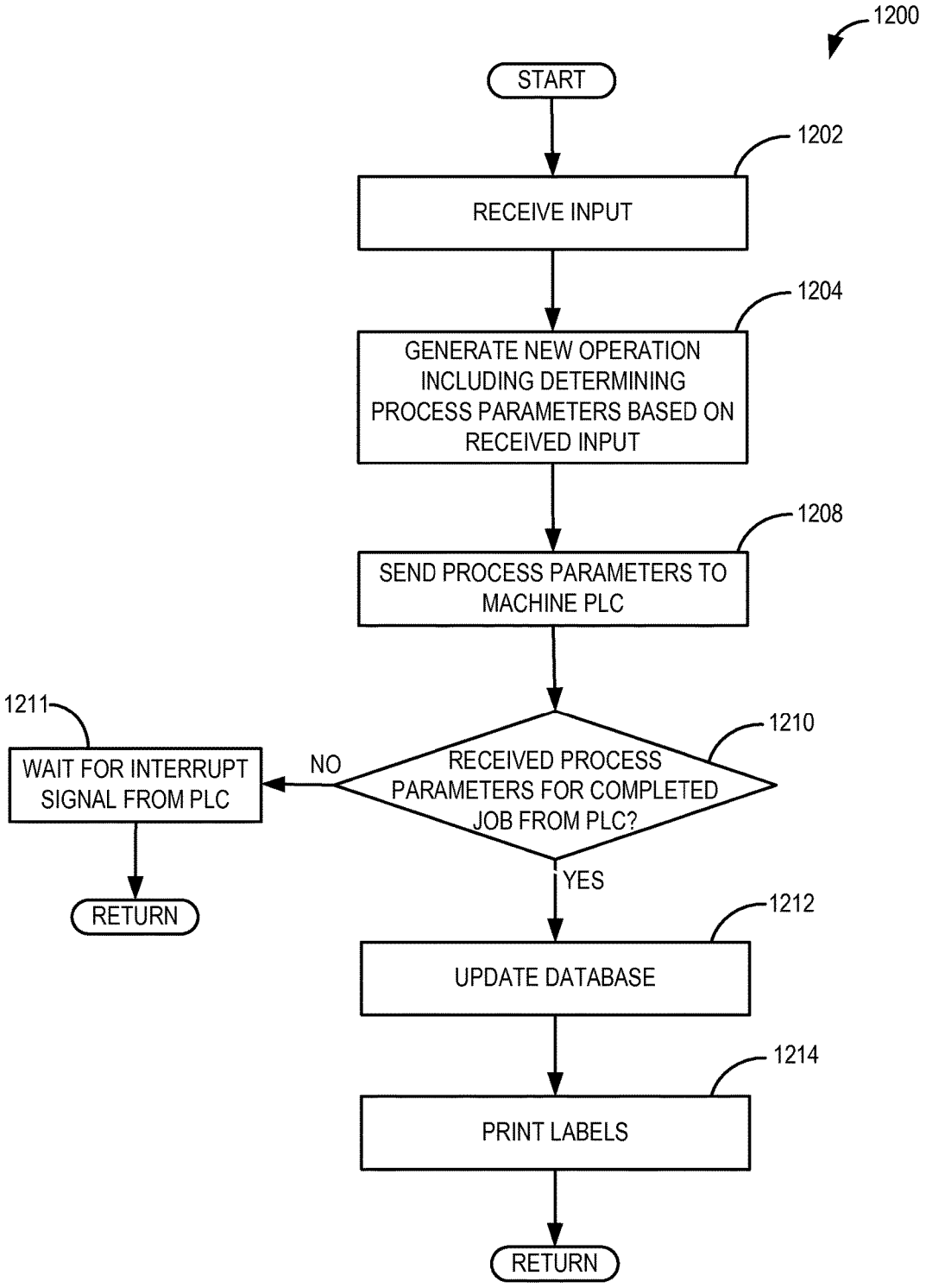
FIG. 12 is a flowchart illustrating an example method for processing a user request for a rewinding operation.

Turning to FIG. 12, it shows a high level flowchart illustrating an example method 1200 for processing a request for operating a winding device, such as winding device 100 at FIG. 1. The winding device may include measuring, rewinding, cutting and slitting functions as discussed above. Method 1200 may be executed by a PC controller, such as controller 1140 at FIG. 11 within a PC, such as PC 1105 at FIG. 11, communicating with the winding device. Method 1200 may be executed based on instructions stored within a memory of the PC controller and in conjunction with signals received from a programmable logic controller (PLC), such as controller 1180 at FIG. 11, included within the winding device.

Method 1200 begins at 1202. At 1202, method 1200 includes receiving a user input. User input may include a request for operating the winding machine. The user input may further include a type of operation that may be performed by the winding machine. The type of operation may include measuring and winding a film or a film-like material from a first roll comprising of rolled film-like material onto a second roll comprising the rolled film-like material of desired length, and measuring and cutting of a sheet of the film-like material from the first roll to a sheet of desired length. The type of operation may also include a slitting operation of the second roll to obtain one or more rolls of one or more desired widths. Further, the user input may include information regarding the film-like material. For example, the user input may include a type of the film-like material, such as polyvinyl, which may include self-adhesive vinyl, sign vinyl, deco vinyl, digital print media, flex films, flock vinyl, sandblast vinyl, masking films, double-sided adhesive films, reflective vinyl films, metal effect vinyl, etc. The user input may further include a desired length of the second roll or the sheets, and a number of rolls or sheets.

In one example, the user input may be received from a user via a user interface, such as user interface 1160 at FIG. 11, included within the PC. For example, the user may enter the user input manually, such as via a keyboard or a touch-screen keyboard of the user interface. Additionally or alternatively, the user may manually select the user input from a database via the user interface. In another example, additionally or alternatively to the manual entry and/or the manual selection, the user input may be received by the PC via a bar code scanner. For example, a user may utilize the bar code scanner to input one or more parameters of the film-like material, such as type of material, manufacturer, etc., by scanning a bar code embedded within a label of the material. The user input may further include user information, such as a name and an identification number for the user. In some examples, the user information including name, identification number and an image (e.g. in a .jpg format) that may be stored in the memory of the PC or a database of the PC, such as database 1120 at FIG. 11, and the user may select the desired user information via the user interface.

Upon receiving user input, method 1200 proceeds to 1204. At 1204, method 1200 includes generating a new operation based on the received user input. Generating a new operation may include determining pre-processing values for one or more process parameters. The process parameters may include one or more of a target length (e.g., the target length may be greater than a desired length input by the user), a winding speed, a desired brake force, a desired cross-cutter speed, a material opacity, etc. The pre-processing values of the process parameters may be determined based on the user input, such as user input at 1202, including the type of material, the desired length, the type of operation that may be performed on the material; and based on historical post-processing values of the process parameters of previously completed operations stored in the database. For example, if a user requests rewinding a polyvinyl film of thickness 0.5 millimeters to a desired length of 10 meters, the pre-processing values for the process parameters may be determined based on the thickness of the poly-vinyl film, the desired length of the roll of the polyvinyl film and historical post processing values of the process parameters of one or more previously completed rewinding operations of poly-vinyl film of same or similar thickness and other material properties.

Upon determining pre-processing values for the process parameters, method 1200 proceeds to 1208. At 1208, method 1200 includes sending the pre-processing values of the process parameters to the PLC. The PLC may then utilize the pre-processing parameters to adjust one or more actuators of the device to perform the desired operation. Details of operating the winding machine based on the pre-processing values will be further elaborated with respect to FIG. 13. For example, the PLC within the winding machine may adjust the pre-processing values of the process parameters during the operation based on feedback from one or more sensors of the winding device to achieve a desired result. Upon completion of the requested operation, the PLC may send the adjusted values (herein referred to a post-processing values) of the process parameters to the PC controller.

Accordingly, method 1200 proceeds to 1210. At 1210, method 1200 includes determining if post-processing values for the process parameters are available from the PLC. Determining if post-processing values for the process parameters are available from the PLC may include determining if an interrupt signal is detected from the PLC. If the answer at 1210 is NO, method 1200 proceeds to 1211. At 1211, method 1200 includes waiting for the interrupt signal from the PLC, which indicates that the operation is completed and the post-processing values for the process parameters are available. In some examples, waiting for the interrupt signal may include prioritizing other tasks. In some other examples, waiting for the interrupt signal may include operating the PC in a low power state until the interrupt signal from the PLC is detected by the PC. If the answer at 1210 is YES, method 1200 proceeds to 1212. At 1212 method 1200 includes receiving the post-processing values from the PLC and storing the post-processing values of the process parameters received from the PLC in the database including historical values.

Next, method 1200 proceeds to 1214. At 1214, the PC controller may send a request to a printer coupled with the PC to print labels including completed operation information, such as length of the roll, type of the material, manufacturer, barcode including the material information, etc.

Figure 13:
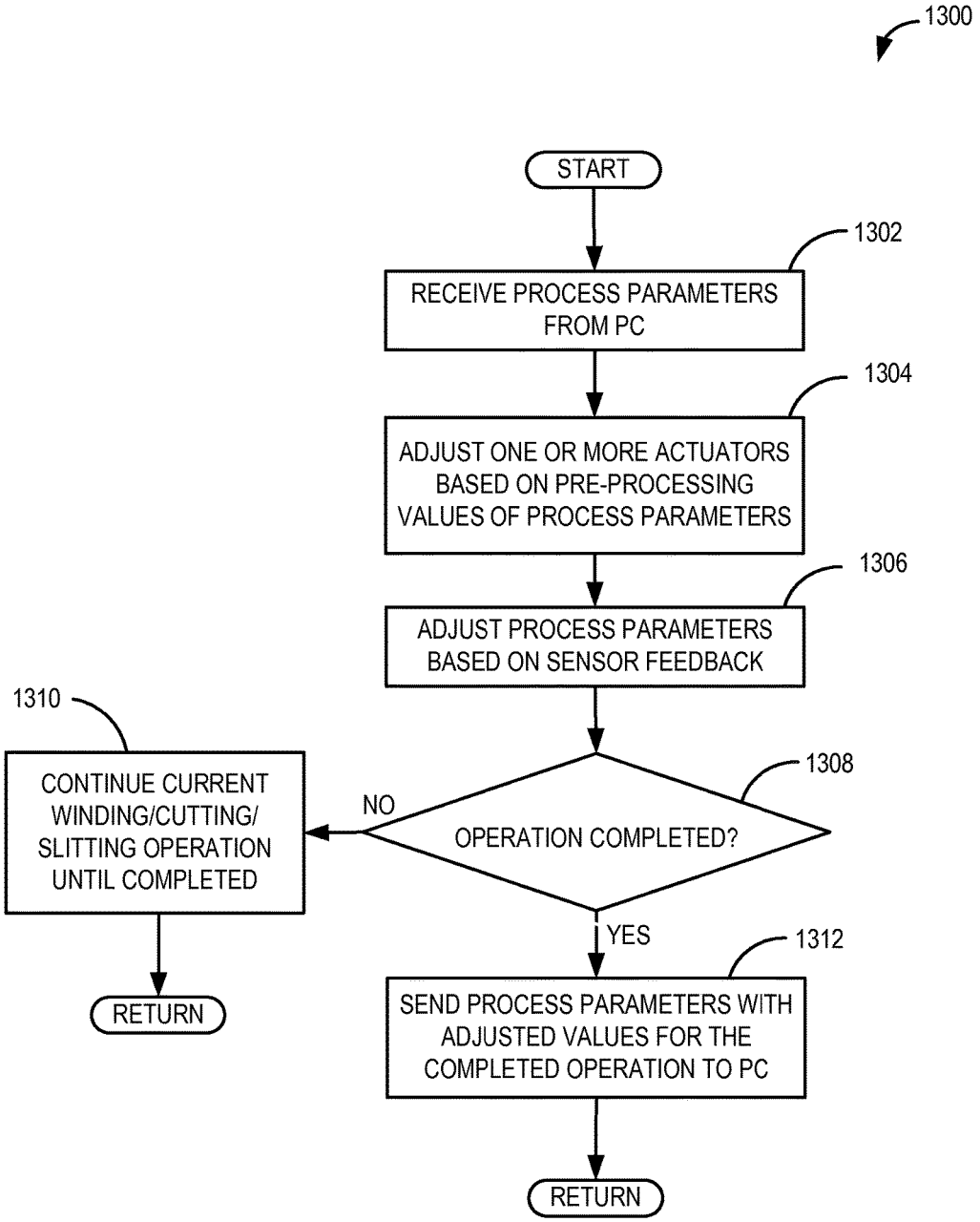
FIG. 13 is a flowchart illustrating an example method for controlling a winding operation based on user input

Turning to FIG. 13, a high-level flow chart illustrating an example method 1300 for controlling an operation of a winding device, such as winding device 100 at FIG. 1, by a PLC is shown. Method 1300 may be executed by a PLC, such as controller 1180 at FIG. 11, based on instructions stored within a memory of the PLC and in conjunction with signals received from a PC controller, such as controller 1140 at FIG. 11, signals received from sensors of the winding device, such as the sensors described above with reference to FIGS. 1-10, and user input. The controller may employ one or more actuators of the winding device, such as various motors discussed with respect to FIGS. 1-10, to adjust winding operation, according to the methods described below.

Method 1300 may begin at 1302. At 1302, method 1300 includes receiving pre-processing values for one or more process parameters from the PC controller. As discussed above with respect to FIG. 12, the pre-processing values may be determined by the PC controller based on historical values for the process-parameters stored in a database and user input.

Upon receiving the values for the process parameters, method 1300 proceeds to 1304. At 1304, method 1300 includes adjusting one or more actuators to perform the operation indicated by the user. Specifically, the controller may adjust a signal delivered to the motors to provide a desired electrical signal, such as current or voltage, to the motors based on the values for the process parameters received from the PC. In one example, the operation may be a winding and cutting operation and may include a slitting operation, such as winding and cutting, and/or slitting a roll of a film-like material. In another example, the operation may be a measuring and cutting operation. Details of a winding and cutting operation will be further described with respect to FIG. 14-17. Next, method 1300 proceeds to 1306. At 1306, method 1300 includes further adjusting the process parameters based on feedback from one or more sensors, such as an optical sensor, a length sensor, a brake current sensor, a rotation speed sensor, etc., shown at FIG. 7. In some examples, additionally, the process parameters may be adjusted based on user input.

Next, at 1308, method includes determining if the operation is complete. Determination of completion of the operation may be based on output from the one or more sensors. For example, a winding operation may be determined to be complete when an output of the length sensor indicates that a desired winding length is reached; and a cutting operation may be determined to be complete based on a position of a cross-cutter. Alternatively, a user may indicate, by pressing a button on the machine interface and/or via the PC user interface, for example, that the operation is completed.

If it is determined that the operation is not complete, method 1300 proceeds to 1310. At 1310, method 1300 includes continuing current operation until the operation is completed. If it is confirmed that the operation is complete, method 1300 proceeds to 1312. At 1312, method 1300 includes sending the post-processing values of the process parameters for the completed job to the PC controller for updating the database and printing labels for the completed operation.

While the above examples illustrate a user initiating a request for an operation via a user-interface included within a PC, in some examples, the user may initiate the request via an interface included within the device. In such cases, the device may be operated without communicating with the PC. When the PC is not utilized, pre-processing values for the process parameters of the operation may be determined by the PLC based on historical values for the process parameters stored within a memory of the PLC. Upon completion of the operation, the PLC may update a table including the historical values with the post-processing values.

Figure 14A:
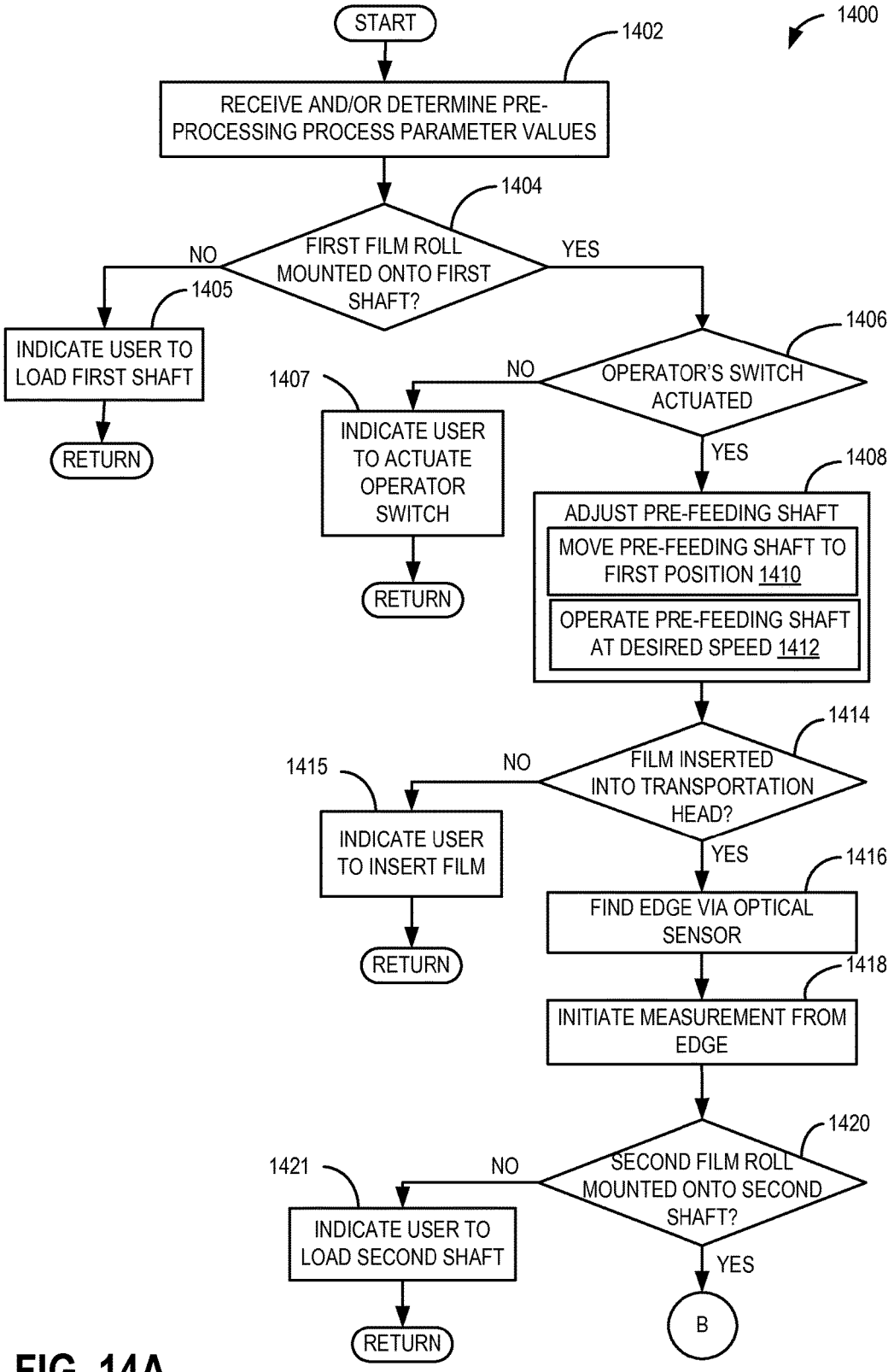
FIG. 14A is a flowchart illustrating an example method for performing a measuring and rewinding operation with a winding device.

FIG. 14A shows a flow chart illustrating an example method 1400 for performing a measuring and rewinding operation with a winding device, such as winding device 100 at FIG. 1. Method 1400 may be executed by a PLC, such as controller 1180 at FIG. 11, based on instructions stored within a memory of the PLC and in conjunction with signals received from a PC controller, such as controller 1140 at FIG. 11, signals received from sensors of the winding device, such as the sensors described above with reference to FIG. 1, and user input.

Method 1400 may begin at 1402. At 1402, method 1400 includes receiving and/or determining pre-processing values for one or more process parameters for a user-requested winding operation. The winding operation may include winding a desired length of a film-like material, such as a polyvinyl film, from a first larger roll onto a second roll of the desired length. The process parameters for the winding job may include a target length, a number of rolls, a winding speed, a desired brake force, a desired cross-cutter speed, a material opacity, etc. In one example, the PLC may receive pre-processing values for the process parameters from a PC coupled to the PLC. Additionally or alternatively, in some examples, the pre-processing values for the process parameters may be determined by the PLC.

Upon obtaining the pre-processing values, method 1400 proceeds to 1404. At 1404, method 1400 includes determining if the first roll is mounted on a first shaft, such as shaft 102 at FIG. 1. For example, a user may mount the first roll on first shaft. Upon mounting the first roll, the user may provide an indication to the PLC that the loading is complete. In some examples, the first shaft may include a weight sensor, which may provide an indication of loading of the first shaft. In some other examples, the user may load the first roll onto the first shaft prior to entering a user request into the PC or the PLC. In such cases, the user request may be assumed to be an indication of loading of the first shaft.

If it is determined that the first shaft is not loaded with the first roll, method 1400 proceeds to 1405 to provide an indication to the user to mount the first roll onto the first shaft. In one example, if the first shaft is not loaded, the PLC may provide an indication to the user via an user interface of the PC or via the winding device to prompt the user to load the first shaft with the first roll. In some examples, additionally or alternatively, if the first shaft is not loaded, the PLC may not send signals to actuators to operate one or more shafts (e.g., in response to an operator actuating an operator's switch to initiate measuring and/or rewinding) until the first shaft is loaded. If it is determined that the first shaft is loaded with the first roll, method 1400 proceeds to 1406.

At 1406, method 400 includes determining if a switch, such as operator's switch 160 at FIG. 1 is actuated. For example, the operators switch may be cyclic switch with multiple outputs. Thus, a first actuation of the operator's switch may provide an indication to the PLC to prepare a transportation head of the winding machine, such as transportation head 150 at FIG. 1 for receiving the film from the first shaft. Therefore, if it is determined that the operator's switch is not actuated, method 1400 proceeds to 1407 to indicate user to actuate the operator's switch for feeding the film into the transportation head. The indication to the user may be provided via the user interface of the PC or via the winding device. If it is determined that the operator's switch is actuated, method 1400 proceeds to 1408. It must be noted that the actions described below with respect to 1408 may be performed after actuating the operator's switch and prior to inserting the film into the transportation head.

At 1408, method 1400 includes adjusting a pre-feeding shaft, such as pre-feeding shaft 210 at FIG. 2A, located within the transportation head of the winding device. Adjusting the pre-feeding shaft may include, at 1410, moving the pre-feeding shaft to a first position via a motor, such as motor 360 at FIG. 3, such that when the film is taken up by the transportation head, the pre-feeding shaft is in direct contact with the film in the transportation head. In one example, the first position of the pre-feeding shaft may be a fixed position. In another example, the first position of the pre-feeding shaft may vary based on one or more parameters (e.g., thickness, smoothness etc.) of the film. For example, assuming that the pre-feeding shaft is at a default position away from the film (that is, film is not in contact with the pre-feeding shaft) before actuation of the operator's switch, as a thickness of the film decreases, a degree of movement of the pre-feeding shaft from the default position towards the film may increase. While the above examples illustrate moving the pre-feeding shaft from a default position that is away from a film transportation path towards a first position that is closer to the transportation path, in some examples, the first position at which the pre-feeding shaft is in contact with the film, may be the default position and in such cases, upon actuation of the operator's switch, the pre-feeding shaft may be maintained at the first position. For example, when two subsequent rewinding operations are performed (that is, if the film is first rewound onto the second roll and cut, and then rewound onto a third roll and cut), upon completion of the first rewinding operation and before commencing the second rewinding operation, the pre-feeding shaft may be in the first position in contact with the film in the transportation head.

Further, adjusting the pre-feeding shaft may include, at 1412, adjusting a pre-feeding shaft speed to a desired feeding speed. The pre-feeding shaft speed may be adjusted via a motor, such as motor 350 at FIG. 3. For example, the PLC may provide a signal to the motor to increase the pre-feeding shaft speed to the desired speed. The desired feeding speed may be a pre-determined feeding speed. In one example, the desired feeding speed may be based on one or more parameters (e.g., thickness, smoothness) of the type of film that is being fed into the device. In another example, the desired feeding speed may be a nominal speed that does not change based on the type of the material used. For example, the pre-feeding shaft may be operated with the nominal speed to facilitate feeding of the film into the transportation head of the winding device. However, subsequently, when the film is inserted into the transportation head, if the device is unable to take-up the film into the transportation head, the feeding speed may be increased gradually by adjusting a speed of the motor driving the pre-feeding shaft, until the film is taken up into the transportation head.

Further, at 1408, upon actuation of the operators switch and prior to insertion of the film into the transportation head, the first shaft on which the first roll is mounted and the second shaft that is utilized for mounting the second roll may be maintained at minimum speed (e.g. zero revolutions per minute). That is, the first shaft may be free to rotate about its axis.

Next, method 1400 proceeds to 1414. At 1414, method 1400 includes determining if the film is inserted into the transportation head. The insertion of the film may be confirmed based on a position of the film within the transportation head. The position of the film may be determined based on one or more of an optical sensing process via an optical sensor and a mechanical sensing process via a measuring wheel. In other words, the position of the film may be determined based on an output from an optical sensor, such as optical sensor 320 shown at FIG. 3, and/or an output of a length sensor, such as a length sensor 220 shown at FIG. 2B.

If it is determined that the film is not inserted into the transportation head, method 1400 proceeds to 1415. At 1415, method 1400 includes providing an indication to the user via the PC or via the winding device to insert the film into the transportation head. In one example, the method may wait until a threshold duration has elapsed without detection of the film within the transportation head after actuating the operator's switch, to provide the indication to the user to insert the film.

If it is confirmed that the film is inserted into the transportation head, method 1400 proceeds to 1416 to detect a leading edge of the film (that is, the front edge along the width of the film). In one example, the determination of the insertion of the film and the detection of the edge of the film may be performed simultaneously based on the outputs from the optical sensor and/or the length sensor. As such, a film that has been inserted into the transportation head from the lower shaft and whose edge has been detected by the one or more sensors may be referred to herein as the referenced film.

Next, upon detecting the leading edge of the film, method 1400 proceeds to 1418. At 1418, method 1400 includes initiating measurement of the length of the film from the detected edge. The length of the film may be determined via the length sensor. In one example, the length sensor may be a measuring wheel that is in continuous contact with the film, and the length of the film may be determined based on a number of revolutions of the measuring wheel.

Upon initiating measurement of the length of the film, method 1400 proceeds to 1420. At 1420, method 1400 includes determining if a second roll is mounted onto a second shaft. For example, a user may mount the second roll on the second shaft. Upon mounting the second roll, the user may attach the edge of the referenced film to the second roll. Further, in one example, the user may provide an indication to the PLC that the loading is complete. In some examples, the second shaft may include a weight sensor, which may provide an indication of loading of the second shaft.

If it is determined that the second shaft is not loaded with the second roll, method 1400 proceeds to 1421 to provide an indication to the user via the PC or the winding device to mount the second roll onto the second shaft. If it is determined that the second shaft is loaded with the second roll, method 1400 proceeds to 1422.

In some examples, upon confirming that the second roll is mounted onto the second shaft, the method may include prompting the user to attach the leading edge of the film that has passed through the transportation head onto the second roll.

Figure 14B:
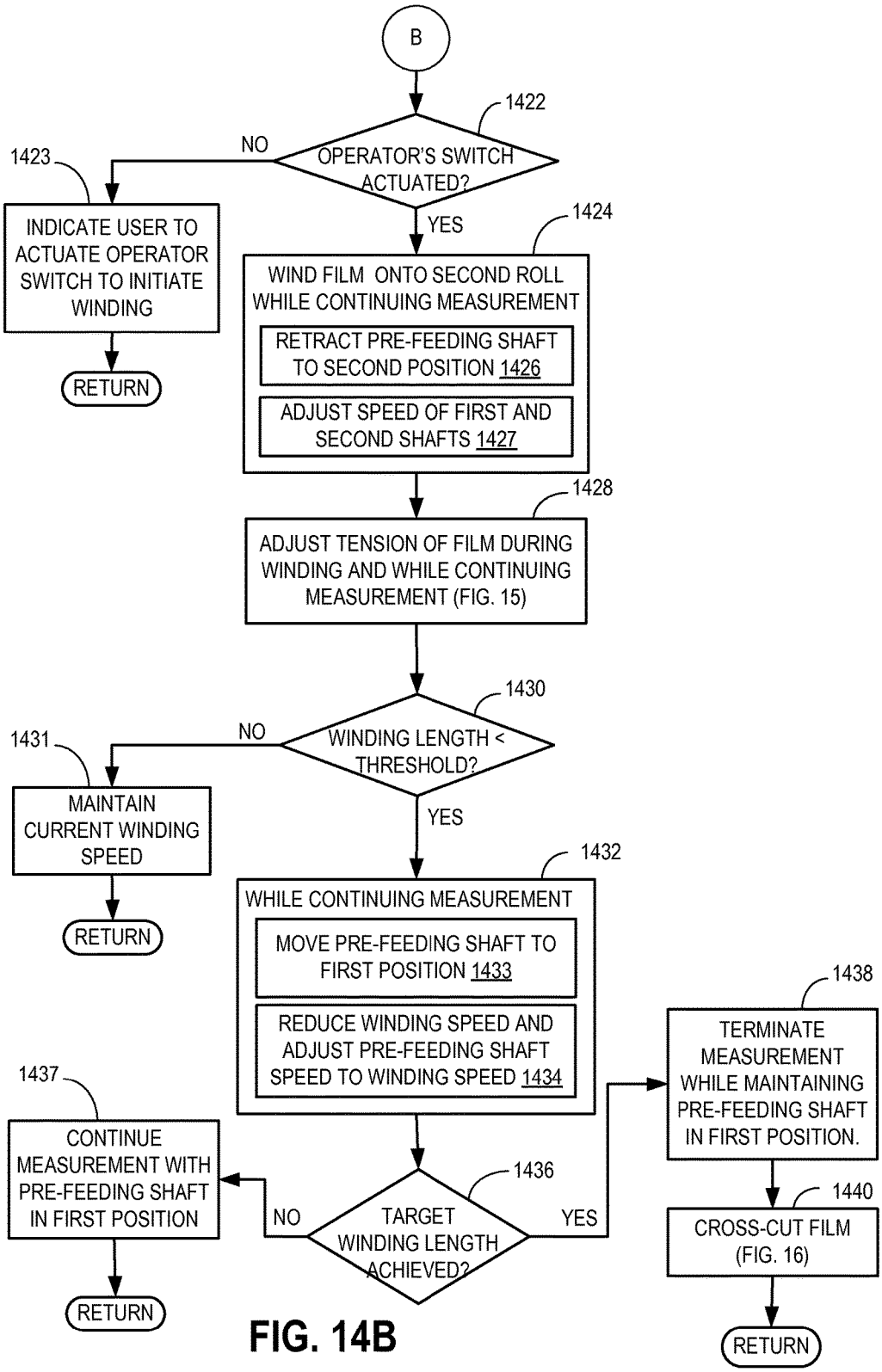
FIG. 14B is a continuation of flowchart illustrated in FIG. 14A.

Turning to FIG. 14B, at 1422, method 1400 includes determining if the operator's switch is actuated. For example, after attaching the film onto the second roll, the user may actuate the operator's switch to initiate the rewinding process of the film onto the second roll. If the answer at 1422 is NO, method 1400 proceeds to 1423 to indicate user to actuate the operator's switch to initiate the winding process. The method then returns.

If the answer at 1422 is YES, method 1400 proceeds to 1424. At 1424, method 1400 includes rewinding the film onto the second shaft. Rewinding the film includes adjusting a speed of the second shaft to a desired winding speed. The desired winding speed may be based on the pre-processing values, which may vary based on the type of film that is being wound. In some examples, the desired speed may be set by a user at the beginning of the operation. In some other examples, the user may adjust the desired speed during the winding process.

Winding the film on the second shaft further includes adjusting a speed of the first shaft based on the speed of the second shaft and a desired tension.

Still further, winding the film on the second shaft includes moving the pre-feeding shaft to a second position while continuing measurement of the length of the film. Moving the pre-feeding shaft to the second position includes retracting the pre-feeding shaft from the first contact position to the second position via the motor controlling the position of the pre-feeding shaft. When the pre-feeding shaft is in the second position, the pre-feeding shaft is not in contact with the film. By moving the pre-feeding shaft to the second position away from the film when the rewinding process is initiated, the speed of the pre-feeding shaft need not be synchronized with the first and the second shaft speeds. Consequently, the tension of the film may be adjusted by adjusting a brake force on the first shaft, and the first and the second shaft speeds. As a result, tension of the film may be controlled with greater precision.

In some examples, the pre-feeding shaft may be moved away from the film to the second position in response to a speed of the second shaft increasing above a threshold as the rewinding process progresses.

Further, at 1424, the length sensor may continue the measurement of the length of the film as the winding process continues. Still further, at 1424, the speed of the retracted pre-feeding shaft (that is, pre-feeding shaft in second position) may be set to minimum speed. In one example, the minimum speed may be zero.

Next, method 1400 proceeds to 1428. At 1428, method 1400 includes adjusting a tension applied to the film that is being rewound while continuously measuring the length as the material is rewinding. The tension may be adjusted based on a desired tension and may be further adjusted based on a diameter of the second roll. Further, the tension may be adjusted by adjusting the brake force applied to the first shaft. The desired tension may be based on a pre-processing tension value that is determined based on historical data. Adjusting the tension based on the diameter includes decreasing the tension as the diameter increases. Thus, at the beginning of the winding process, the winding device may be operated with a first desired tension value that is greater than a second desired tension value towards the end of the winding process. The tension may be further adjusted based on a feedback mechanism from a brake current sensor coupled to a DC brake for the first shaft. Details of adjusting the tension will be further elaborated with respect to FIG. 15.

Next, method 1400 proceeds to 1430. At 1430, the method includes determining if a remaining winding length is less than a threshold length. The remaining winding length may be determined based on the desired length input by the user, the target length generated by the PC, and a current length based on length sensor output. If the remaining winding length is not less than the threshold, method 1400 proceeds to 1431. At 1431, method 1400 includes maintaining the current winding speed by maintaining the first and the second shaft speeds, and the current brake force. Further, at 1431, the measurement of the length may continue. If the remaining length is less than the threshold, method 1400 proceeds to 1432.

At 1432, method 1400 includes continuing measurement and further includes, at 1433, moving the pre-feeding shaft from the second position to the first position. By moving the pre-feeding shaft to the first position, the pre-feeding shaft makes contact with the film. In some examples, at 1433, method 400 may include moving the pre-feeding shaft to a third position different from the first position. In the third position, the pre-feeding shaft makes contact with the film; however, a force applied by the pre-feeding shaft onto the material may be different from the first position. The third contact position may be based on the desired tension, for example. The method further includes, at 1434, reducing the winding speed by adjusting the speed of the first and the second shafts, adjusting the pre-feeding shaft speed based on the winding speed, and adjusting the tension via the brake force applied to the first shaft.

Upon moving the pre-feeding shaft to the first position and adjusting the speeds of the first, the second, and the pre-feeding shafts, method 1400 proceeds to 1436. At 1436, method 1400 includes determining if the target length is achieved. If the answer at 1436 is NO, the target length is not achieved. Accordingly, method 1400 proceeds to 1437, where the measurement of the film and the winding of the film onto the second shaft may continue with the pre-feeding shaft in the first position. If the answer at 1436 is YES, the target length is achieved and the method proceeds to 1438. At 1438, method 1400 include terminating length measurement, stopping rotation of the first, the second, and the pre-feeding shafts while maintaining the pre-feeding shaft in the first contact position.

Next, method 1400 proceeds to 1440 to cross-cut the film to separate the two rolls. Details of cross-cutting the film will be further described with respect to FIG. 16.

Figure 15:
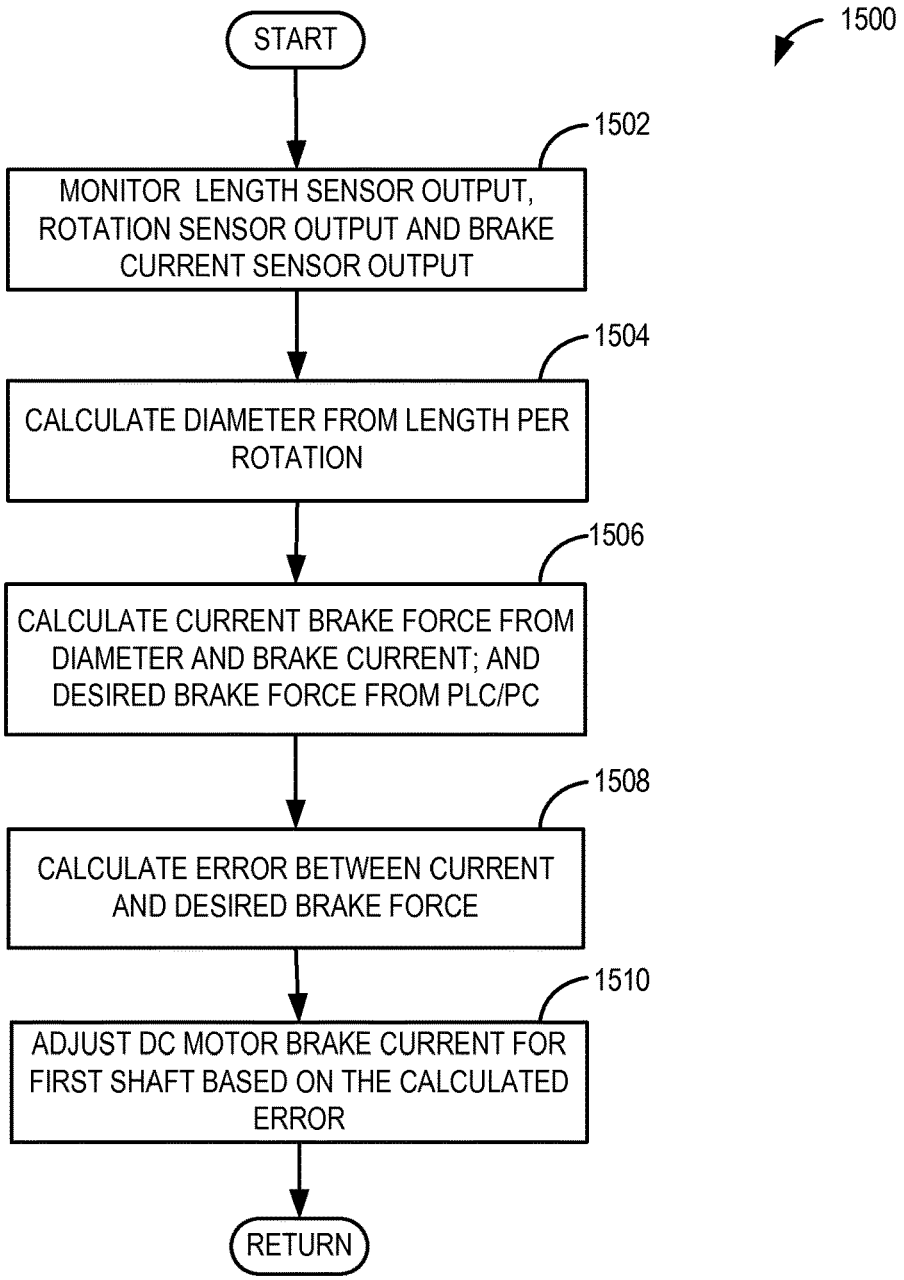
FIG. 15 is a flow chart illustrating an example method for adjusting tension of the film during a winding operation with a winding device.

FIG. 15 shows a flow chart illustrating an example method 1500 for adjusting tension of the film during a winding operation with a winding device, such as winding device 100 at FIG. 1. Specifically, the tension may be adjusted by adjusting a brake force applied by a DC-brake onto a first shaft, such as shaft 102 at FIG. 1. For example, to obtain a greater tension, a larger braking force may be applied and to obtain a lesser tension, a smaller braking force may be applied. The brake force may be adjusted based on a brake current supplied to the DC-brake.

Method 1500 may be executed by a PLC, such as controller 1180 at FIG. 11, based on instructions stored within a memory of the PLC and in conjunction with signals received from a PC controller, such as controller 1140 at FIG. 1, signals received from sensors of the winding device, such as the sensors described above with reference to FIGS. 1-10, and user input. Method 1500 may be performed in conjunction with method 1400 described above at FIG. 14. Specifically, method 1500 may be performed at step 1428 during winding of the film onto the second roll. The adjustment of tension may be a continuous process and may be carried out simultaneously with measurement until the target length is achieved Method 1500 begins at 1502. At 1502, method 1500 includes monitoring an output of a length sensor, such as the length sensor 220 shown at FIG. 2B, an output of one or more rotation sensors, such as rotation sensors 206 and 208 shown at FIG. 2A and an output of a brake current sensor. The length sensor may be positioned within a transportation head, such as transportation head 150 shown at FIG. 1 and may be in continuous contact with the film. In one example, the length sensor may be a measuring wheel and the length of the film may be determined based on a number of revolutions of the wheel. The rotation sensor may be coupled to the first shaft, and the output of the rotation sensor may be utilized to determine an outer diameter of a first roll, such as roll 106 shown at FIG. 1 that may be mounted on the first shaft. The brake current sensor may be coupled in between the first shaft and a DC brake motor providing a braking force to the first shaft. The output of the brake current sensor may be utilized to determine a braking moment.

At 1504, method 1500 includes determining an outer diameter of the first roll mounted on the first shaft based on the length sensor output and the rotation sensor output.

Next, at 1506, method 1500 includes determining a current braking force based on the determined outer diameter and the brake current sensor output, and determining a desired brake force.

In one example, the desired brake force may be based on the outer diameter of the first roll, a thickness of the film, and a winding speed. For example, as the diameter of the first roll decreases and a diameter of a second roll mounted onto a second shaft increases; a lower tension may be desired. Therefore, the desired braking force may be lower as the diameter of the second roll increase. Further, as a thickness of the film increases, the desired tension may decrease.

In another example, the desired brake force may be based on a tension set point that may be input by a user. In such cases, the desired brake force may be calculated by a PC communicating with the PLC during determination of pre-processing values for one or more process parameters of the winding operation. For example, the desired brake force may be determined by the PC at step 1402, which may then be sent to the PLC. Alternatively, the desired brake force may be determined by the PLC. Method 1500 may then proceed to 1508.

Next, at 1508, method 1500 includes calculating an error between the current braking force and the desired braking force. In one example, a proportional-integral-derivative (PID) controller may be utilized to calculate the error and control the braking force. Various other control architectures can be used, such as a proportional controller, or a proportional integral controller, or various other controllers including feedback and feed forward combined control action.

Upon calculating the error, the method proceeds to 1510 to adjust the DC motor brake current for the first shaft to provide the desired braking force. The method may then return.

Figure 16:
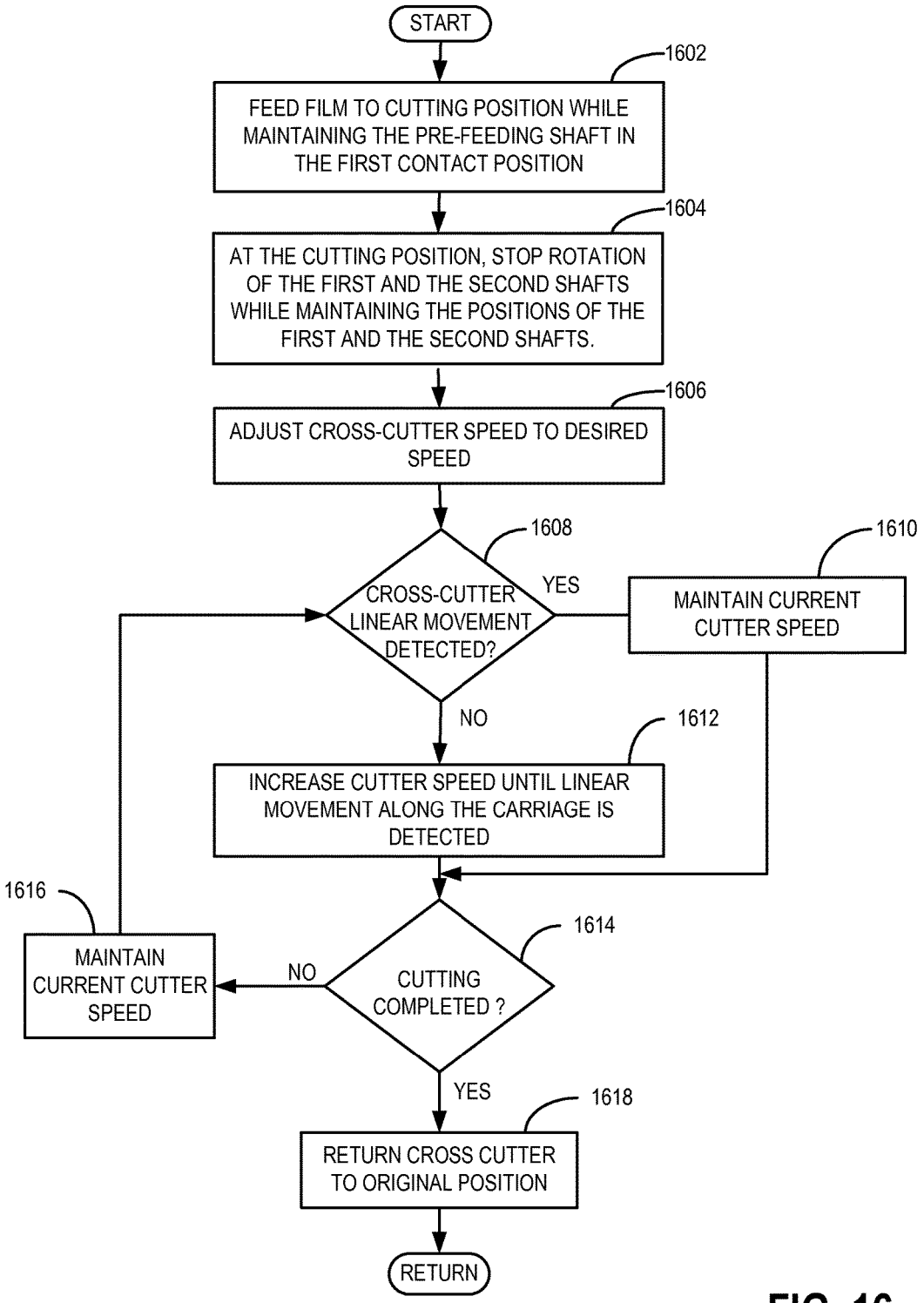
FIG. 16 is a flow chart illustrating an example method for performing a cutting operation with a winding device.
Figure 17:
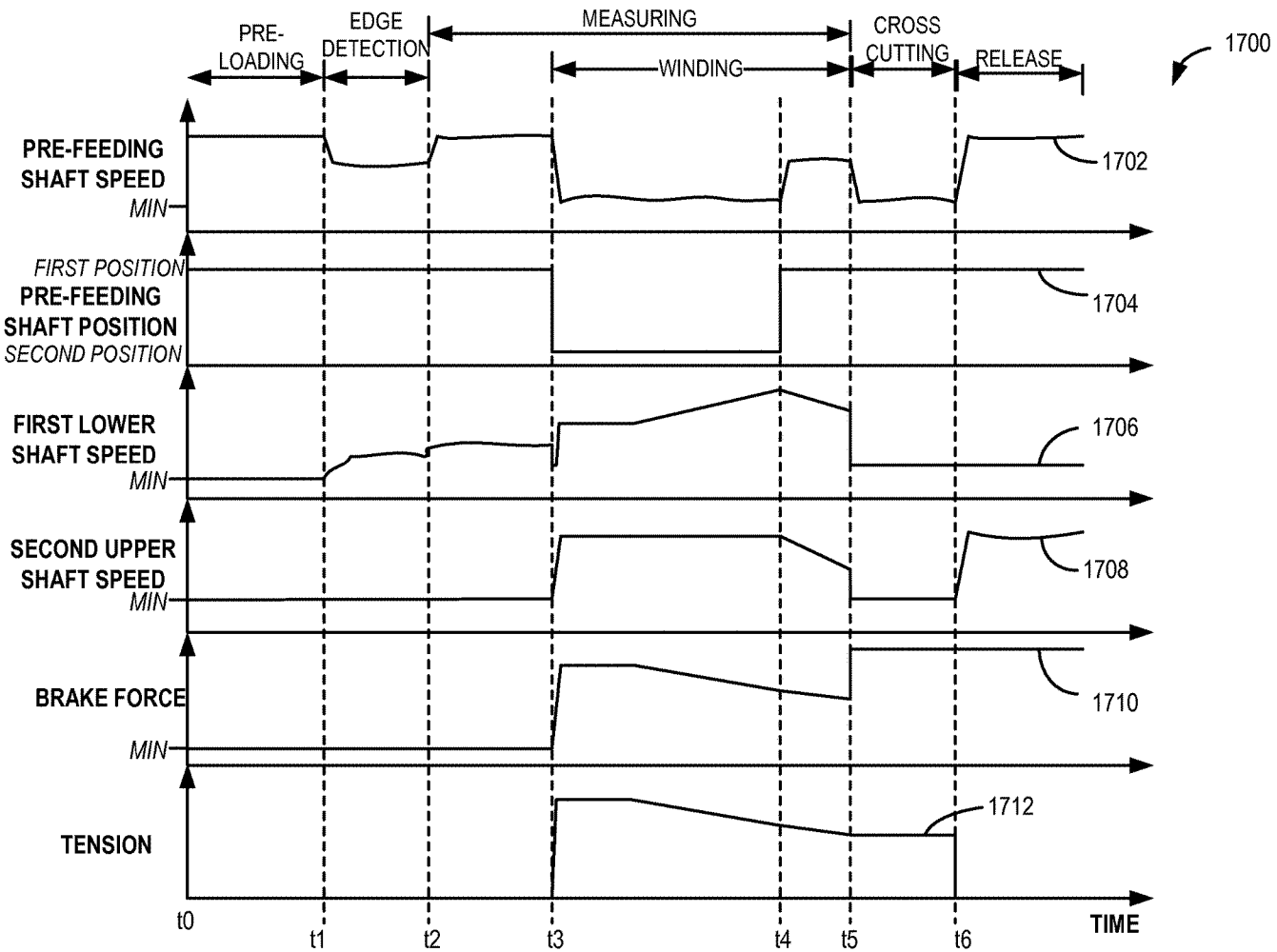
FIG. 17 shows an example operating sequence for a winding device according to the present disclosure.

FIG. 16 shows a flow chart illustrating an example method 1600 for performing a cutting operation with a winding device, such as winding device 100 at FIG. 1. The cutting operation may be performed by utilizing a cutting device, such as device 110 at FIG. 1 including cross-cutting blades mounted on a carriage, such as blades 830 and carriage 820 shown at FIG. 8A. Method 1600 may be executed by a PLC, such as controller 1180 at FIG. 11, based on instructions stored within a memory of the PLC and in conjunction with signals received from a PC controller, such as controller 1140 at FIG. 11, signals received from sensors of the winding device, such as the sensors described above with reference to FIGS. 1-10, and user input. Method 1600 may be performed in conjunction with method 1400 described above at FIG. 14. Specifically, method 1600 may be performed at step 1440 upon completing the winding of the film onto the second roll.

Method begins at 1602. At 1602, method 1600 includes adjusting the film to a cutting position while maintaining the pre-feeding shaft in the first contact position. The film may be adjusted to the cutting position by adjusting the first and second shaft speeds, for example. Further, the brake force may be adjusted in addition to the first and second shaft speeds to provide the desired tension. Further, adjusting the film to the cutting position may include adjusting a position of a cutting bar, such as cutting bar 910 at FIG. 9 to a first cutting bar position. When in the first cutting bar position, the cutting bar may be in direct contact with the film. The cutting bar may be maintained in the first cutting bar position until the cutting operation is completed.

At the cutting position, method 1600 includes, at 1604, stopping rotation of the first and the second shafts while maintaining the current positions of the first and the second shafts. Further, the pre-feeding shaft may be maintained at the first position. The first and the second shafts positions may be maintained by adjusting a brake applied to the first and the second shaft. In one example, the brake maybe a DC-brake.

Next, at 1606, method 1600 includes adjusting a cross-cutter speed to a desired speed. The cross-cutter speed may be adjusted via a motor, such as motor 810 at FIG. 8A. Further, during the cutting operation, as the cutting blades cut the film, the pre-feeding shaft may be maintained in the first position in contact with the film.

Next, method 1600 proceeds to 1608 to confirm if a linear movement of the cross-cutter is detected. The linear movement of the cross-cutter may be detected based on a change in position of the cross-cutter, via a position sensor, for example.

If the answer at 1608 is YES, method 1600 proceeds to 1610. At 1610, method 1600 includes maintaining the current cross-cutter speed. However, if it determined that the cross-cutter is not moving, that is, if the answer at 1608 is NO, method 1600 proceeds to 1612. At 1612, method 1600 includes increasing the cross-cutter speed until the linear movement of the cutter is detected.

Next, method 1600 proceeds to 1614. At 1614, method 1600 includes determining if the cutting operation is completed. For example, the progress or the completion of the cutting operation may be determined based the position of the cross cutter and/or a distance travelled by the cross cutter along a linear guiding, such as linear guiding 840 at FIG. 8A.

If it is confirmed that the cross-cutting operation is completed, method 1600 proceeds to 1618. At 1618, method 1600 includes returning the cross-cutter to the original position. Further, method 1600 includes releasing the cutting bar to a second cutting bar position such that the cutting bar is not in contact with the material. However, if it is confirmed that the cross-cutting operation is not completed, method 1600 proceeds to 1616 to operate the cutter at the current speed. Subsequently, method 1600 may return to 1608.

Upon confirming that the cross-cutting operation is complete, if a subsequent winding operation is in the queue, the film may not be released from the transportation head and the pre-feeding shaft may be maintained in the first contact position. However, if no subsequent winding operations are in queue, the pre-feeding shaft may be moved to the second position away from the film and the film may be released from the transportation head.

FIG. 17 shows a map 1700 that illustrates an example operation of a winding device, such as winding device 100 at FIG. 1, for processing a film or a film-like material. The processing may include rewinding of the film from a first roll onto a second roll, cutting of the film after winding, and slitting of the second roll into one or more rolls of one or more desired widths. The sequence of FIG. 17 may be provided by executing instructions in the system of FIGS. 1-10 according to the methods of FIGS. 12-16. Vertical markers at times t0-t6 represent times of interest during the sequence. Specifically, map 1700 depicts pre-feeding shaft speed at plot 1702 and the pre-feeding shaft speed increases in the direction of Y-axis arrow, pre-feeding shaft position at plot 1704, first lower shaft speed at plot 1706 and the first lower shaft speed increases in the direction of Y-axis arrow, second upper shaft speed at plot 1708 and the second upper shaft speed increases in the direction of Y-axis arrow, brake force applied onto the first upper shaft at plot 1710 and the brake force increases in the direction of Y-axis arrow, and tension or force applied to the material that is being processed by the winding machine at plot 1712 and the tension increases in the direction of Y-axis arrow. All plots are shown over time along the X-axis.

The sequence begins at time t0. At t0, the first roll may be mounted on the first lower shaft and an operator may initiate a pre-feeding mode of operation, by actuating an operator's switch, for example. Thus, between t0 and t1, the winding device may be operating in the pre-feeding mode, which includes operating a pre-feeding shaft, such as pre-feeding shaft 210 at FIG. 2B, at a desired speed and adjusting the position of the pre-feeding shaft to a first position which enables contact of the pre-feeding shaft with the film when the film moves through the transportation head. As the pre-feeding shaft rotates, one or more idler shafts, such as shafts 152 at FIG. 1, in a transportation head, such as transportation head 150 at FIG. 1, that are coupled to the pre-feeding shaft may also begin rotating. Thus, when the winding device is operating in the pre-feeding mode, the transportation head is prepared to receive the material from the first lower shaft.

Next, at t1, the operator may insert the film from the first roll into the transportation head of the winding machine. Thus, between t1 and t2, due to the rotation of the pre-feeding shafts and the idler shafts, the material may begin traveling through the transportation head. As the material is taken-up by the transportation head, an optical sensor system including an optical sensor and a detection light, may begin scanning for a front-edge of the film. In one example, based on whether or not the light is detected by the optical sensor, the absence or presence of the material may be determined. For example, if the light is detected by the sensor, it may be determined that the material is absent; and if the light is not detected by the sensor, it may be inferred that the material is present. In some examples, the detection light may be applied back and forth along the material in the transportation head and a change in absorption pattern may be utilized to detect a front-edge of the film. In some other examples, differences between one or more properties of the light applied and the one or more properties of the light detected by the optical sensor may be utilized to determine the presence of the material and/or detect an edge of the material. As the material is being taken up by the transportation head, the film may start unwinding from the first roll mounted on the first lower shaft. Between times t0 and t2, a first motor driving the first lower shaft may not be actuated. Thus, the first lower shaft may be free to rotate about its axis. Further, between t1 and t2, during the detection of the front-edge of the film, the pre-feeding shaft speed may be reduced and the pre-feeding shaft position may be maintained in the first position. As discussed earlier, in the first position, the pre-feeding shaft may be in contact with the film.

At t2, the front-edge of the film may be detected. In response to detecting the front-edge, a measuring operation may begin at t2. The measuring operation includes measuring a length of the material that is being unwound from the first roll and rewound onto the second roll mounted on the second upper shaft based a length sensor. The measurement may begin from the detected edge. In one example, the length sensor may be a measuring wheel that may be in constant contact with the material during the winding operation. The measuring operation may continue until a desired length of the material is rewound on the second shaft and a cutter for cross-cutting the material is in position for cutting the material. Further, between t2 and t3, the pre-feeding shaft speed may be increased in order to move the front-edge of the material out of the transportation head for attaching the material into the second roll mounted on the second upper shaft. During this time, the first lower shaft may rotate based on the speed of the pre-feeding shaft. Still further, between t2 and t3, the pre-feeding shaft may continue to remain in the first position maintaining contact with the material.

At time t3, the operator may attach the front edge of the material to the second roll and initiate a rewinding operation. For example, upon attaching the front edge of the material to the second roll, the operator may initiate the rewinding operation by actuating the operator switch. In response to the initiation of the rewinding operation, at t3, the pre-feeding shaft may be moved from the forward position to a retract position so that the pre-feeding shaft is not in contact with the material. For example, a signal may be provided by a controller to a retraction motor, such as motor 360 at FIG. 3 to move the pre-feeding shaft to the retract position. The signal from the controller may be converted into an electrical signal, such as a current or a voltage signal, for the retraction motor. In the retract position, the pre-feeding shaft may be set back from the film, for example by 10 millimeters, in order to break contact with the film. By retracting the pre-feeding shaft in response to initiation of the rewinding operation, a tension or force applied to the material may be controlled consistently with increased precision.

Further, in response to initiation of the rewinding operation, after the pre-feeding shaft is retracted, the speed of the pre-feeding shaft may be decreased to a minimum speed. In one example, the minimum speed may be zero rpm.

Further, in response to initiation of the rewinding operation, the first lower shaft speed may be increased by a first motor and the second upper shaft speed may be increased by a second motor. The first and the second shaft speeds may be based on a desired rewinding speed and a desired tension of the material. In one example, the desired rewinding speed and the desired tension may be input by the operator and the first and second shaft speeds may be estimated by the PLC and/or based on the input.

Still further, in response to the initiation of the rewinding operation, a brake force applied to the material may be adjusted by adjusting a DC-brake controlling the braking of the first lower shaft. Thus, the first lower shaft speed may be adjusted by the first motor and the DC-brake. Consequently, the tension may be adjusted to the desired tension.

Taken together, in response to the initiation of the rewinding operation by the operator, the pre-feeding shaft may be adjusted from a forward position to a second retract position, the pre-feeding shaft speed may be decreased, the first lower shaft speed and the second upper shaft speed may be increased, and the brake force may be increased. By adjusting the first lower shaft speed, the second upper shaft speed, and the brake force, the tension applied onto the material during the rewinding process may be adjusted. Further, by retracting the pre-feeding shaft during the rewinding process, the need for adjusting the speed of the pre-feeding shaft for tension control is reduced. Consequently, more accurate and faster control of the tension may be achieved.

Next, between t3 and t4, during the rewinding process, as the diameter of the second roll increases, the first shaft speed, the second shaft speed and the brake force may be adjusted to gradually reduce the tension. In one example, the second shaft speed may be maintained constant at a desired rewinding speed and the speed of the first shaft may be adjusted via the first motor and/or the DC-brake. The pre-feeding shaft may be maintained in the retract position during the rewinding.

At t4, a remaining rewinding length may decrease below a threshold. Consequently, the pre-feeding shaft may be moved back to the forward position and the speed of the pre-feeding shaft may be adjusted based on the first and the second shaft speeds and the desired tension. The pre-feeding shaft may be maintained at the forward position, maintaining contact with the material, until the material is cut and released.

Next, between t4 and t5, the first shaft speed and the second shaft speed may be decreased and the brake force may be adjusted to provide the desired tension.

Next, at t5, the desired winding length may be reached. Upon reaching the desired winding length, the material may be adjusted to a desired cutting position and a desired cutting tension by adjusting the first and second shaft speeds, and the brake force. Further, when the material is at the desired cutting position, the position of the first and the second shafts may be maintained constant by the first and the second motors. Further, at t5, a position of the cross-cutter may be adjusted to a desired cutting position.

Upon setting the film at the desired cutting position, the material may be clamped in the transportation head by the cutting bar 910. Upon clamping the material in the transportation head, between t5 and t6, the cross-cutter may be driven via a motor, such as motor 810 at FIG. 8 to cut the material along the width of the material.

Upon cutting the material, based on the subsequent operation, the material may be either released from the transportation head towards the lower shaft (e.g., if no further winding operations are expected) or the cut edge may be detected, and pushed towards the second upper shaft through the transportation head if a subsequent winding operation is expected. Further, during the release when no subsequent winding operation is expected, the pre-feeding shaft may be moved from the first forward position to the retract position. However, if subsequent release operation is expected, the pre-feeding shaft may be maintained in the forward position to enable edge detection and initiation of measurement of the subsequent winding operation.

As one embodiment, a method for a winding device includes transporting a rolled film-like media from a first roller mounted on a first lower shaft to a second roller mounted on a second upper shaft via a third middle shaft, the third middle shaft set in a first position; and responsive to initiation of rewinding of the film-like media onto the second roller, adjusting the third shaft to a second different position. A first example of the method includes responsive to the initiation of rewinding, adjusting a tension of the film-like media based on a brake force applied to the first lower shaft, a first speed of the first shaft, and a second speed of the second shaft. A second example of the method optionally includes the first example and further includes responsive to a remaining rewinding length decreasing below a threshold length, moving the third middle shaft to the first position, and maintaining the third shaft in the first position until the rewinding is complete. A third example of the method optionally includes one or more of the first and second examples, and further includes wherein the brake force is based on a thickness of the film-like media, a learned brake-force for the thickness based on stored brake-force values in a database, and an outer radius of the second roller including the film-like material. A fourth example of the method optionally includes one or more of the first through third examples, and further includes, wherein the first shaft speed, the second shaft speed, and the third shaft speed are controlled by a first motor, a second motor and a third motor respectively; and wherein the adjustment of the third shaft between the first position and the second position is controlled by a fourth motor. A fifth example of the method optionally includes one or more of the first through fourth examples, and further includes, wherein when operating in the first position, the third shaft is in contact with the film-like media, and when operating in the second position, the third shaft is not in contact with the film-like media. A sixth example of the method optionally includes one or more of the first through fifth examples, and further includes, maintaining the first position of the third shaft after rewinding during a cutting operation of the film-like material to separate the second roll from the first roll. A seventh example of the method optionally includes one or more of the first through fifth examples, and further includes, responsive to expecting a second rewinding operation after the cutting operation, maintaining the third shaft in the first position and not releasing the film-like material from a transportation head; and responsive to not expecting the second rewinding operation after the separation, adjusting the third shaft to the second position and releasing the film-like material from the transportation head. A eighth example of the method optionally includes one or more of the first through seventh examples, and further includes, wherein during the transportation, an edge of the film-like media is detected based on an optical sensor output. A ninth example of the method optionally includes one or more of the first through eighth examples, and further includes, wherein the remaining winding length is determined based on a number of rotations and a rotation speed of a measuring wheel that is in direct contact with the film.

As another embodiment, a method includes responsive to a user input, determining, via a first controller, pre-processing values for one or more process parameters for winding a film-like media from a first roll mounted on a first lower shaft of a winding machine onto a second roll mounted on a second upper shaft via a third adjustable middle shaft, the determination based on one or more properties of the film-like material, a desired number of rolls, a desired winding length for each of the desired number of rolls, and historical values of the one or more process parameters stored in a database of the controller; and communicating the pre-processing values from the first controller to a second controller within the device. A first example of the method includes responsive to an interrupt signal from the second controller, receiving one or more post-processing values of the one or more process parameters from the second controller; and updating the database of the first controller with the one or more post-processing values. A second example of the method optionally includes the first example and further includes, wherein the one or more process parameters include a winding length, a rewinding speed, a desired brake force, a cross cutting speed, and a material opacity.

In another embodiment, a rewinding device for a film-like media, includes a first lower shaft driven by a first motor; a second lower shaft driven by a second motor; a third middle shaft located within a transportation head between the first and the second shafts, the third shaft driven by a third motor; a fourth motor for adjusting a position of the third middle shaft between a first position and a second position; a cutting device including one or more cutting blades driven by a fifth motor; a length sensor coupled within the transportation head; an optical sensor coupled within the transportation head; and a controller configured with instructions stored in non-transitory memory, that when executed, cause the controller to: responsive to a first condition, adjust the third middle shaft to a first position; and responsive to a second condition, adjust the third middle shaft from the first position to a second position. A first example of the device includes, wherein the first condition includes a first actuation of a cyclic switch by a user operating the device. A second example of the device optionally includes the first example and further includes, wherein the controller includes further instructions for: responsive to the first condition, detecting an edge of the film-like media based on an output of the optical sensor; responsive to the detection, measuring a length of the film-like media from the detected edge based on an output of the length sensor; and not driving the first and the second shafts. A third example of the device optionally includes one or more of the first and second examples, and further includes, wherein the second condition includes a second actuation of the cyclic switch by the user. A fourth example of the device optionally includes one or more of the first through third examples, and further includes, wherein the controller includes further instructions for: responsive to the second condition, increasing a first speed of the first shaft, increasing a second speed of the second shaft, and adjusting a brake force applied to the first shaft, the increasing of the first and the second speeds and the adjustment of the brake force based on a desired tension applied to the film-like media. A fifth example of the device optionally includes one or more of the first through fourth examples, and further includes, wherein the controller includes further instructions for: responsive to the second condition, continuing measurement of the length based on the output of the length sensor; and responsive to a third condition, including the measured length of the film-like media increasing above a threshold length, adjusting the third middle shaft from the second position to the first position while continuing the measurement of the length and adjusting the first shaft speed, the second shaft speed and the brake force based on the desired tension. A sixth example of the device optionally includes one or more of the first through fifth examples, and further includes, wherein the threshold based on a desired length of the film-like media, and wherein when operating in the first position, the third shaft is in contact with the film-like media, and when operating in the second position, the third shaft not in contact with the film-like media.

In another representation, a method comprises: responsive to a user input, determining, via a first controller, one or more process parameters for winding a film-like media from a first roll mounted on a first lower shaft of a winding machine onto a second roll mounted on a second upper shaft via a third middle shaft based one or more properties of the film-like material and a desired winding length; sending the one or more process parameters from the first controller to a second controller; detecting, via the second controller, an edge of the film-like media based on an optical sensor output; responsive to the edge detection, measuring via the second controller a winding length of the film-like media; responsive to a user request to initiate winding, adjusting, via the second controller, a first current supplied to a first motor controlling a first rotating speed of the first shaft, and a second current supplied to a second motor controlling a second rotating speed of the second shaft based on the received process parameters; and further adjusting, via the second controller, a third current supplied to a third motor controlling a third rotating speed of the third shaft, and a fourth current supplied to a fourth motor controlling a forward movement and a backward movement of the third shaft; and responsive to the winding length reaching the desired winding length, adjusting a fifth current supplied to a fifth motor controlling a movement of a cross-cutter. The method further comprises: determining, via the first controller, a desired brake force based on the one or more process parameters; determining, via the second controller, a current brake force based on a length sensor output, a rotation sensor output, and a brake current sensor output; and adjusting, via the second controller, the second current to the second shaft based on the difference between the desired brake force and the current brake force. The method further comprises sending one or more adjusted current values from the second controller to the first controller; and updating a database of the first controller, by the first controller, with the one or more adjusted current values. The method includes wherein the one or more process parameters include a winding length, a rewinding speed, a desired brake force, a cross cutting speed, and a material opacity.

Note that the example control and estimation routines included herein can be used with various device configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to other types of winding devices used for processing other types of material. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a winding device, comprising:

transporting a rolled film-like media from a first roller mounted on a first lower shaft to a second roller mounted on a second upper shaft via a third middle shaft, the third middle shaft set in a first position; and responsive to initiation of rewinding of the film-like media onto the second roller, adjusting the third shaft to a second different position, and adjusting a tension of the film-like media based on a brake force applied to the first lower shaft, a first speed of the first shaft, and a second speed of the second shaft;

wherein the brake force is based on a thickness of the film-like media, a learned brake-force for the thickness based on stored brake-force values in a database, and an outer radius of the second roller including the film-like media.

2. The method of claim 1, further comprising:

responsive to a remaining rewinding length decreasing below a threshold length, moving the third middle shaft to the first position, and maintaining the third shaft in the first position until the rewinding is complete.

3. The method of claim 2, further comprising:

maintaining the first position of the third shaft after rewinding during a cutting operation of the film-like media to separate a second roll from a first roll.

4. The method of claim 3, further comprising:

responsive to expecting a second rewinding operation after the cutting operation, maintaining the third shaft in the first position and not releasing the film-like media from a transportation head; and responsive to not expecting the second rewinding operation after the separation, adjusting the third shaft to the second position and releasing the film-like media from the transportation head.

5. The method of claim 1, wherein the first speed, the second speed, and a third speed of the third middle shaft are controlled by a first motor, a second motor, and a third motor, respectively; and wherein the adjustment of the third shaft between the first position and the second position is controlled by a retraction motor.

6. The method of claim 1, wherein, when operating in the first position, the third shaft is in contact with the film-like media, and, when operating in the second position, the third shaft is not in contact with the film-like media.

7. The method of claim 1, wherein, during the transportation, an edge of the film-like media is detected based on an optical sensor output.

8. A method for a winding device, comprising:

transporting a rolled film-like media from a first roller mounted on a first lower shaft to a second roller mounted on a second upper shaft via a third middle shaft, the third middle shaft set in a first position;

responsive to initiation of rewinding of the film-like media onto the second roller, adjusting the third shaft to a second different position, and adjusting a tension of the film-like media based on a brake force applied to the first lower shaft, a first speed of the first shaft, and a second speed of the second shaft;

responsive to a remaining rewinding length decreasing below a threshold length during rewinding when the remaining length is below the threshold length, moving the third shaft from the second position to the first position, and maintaining the third shaft in the first position until the rewinding is complete;

wherein the remaining rewinding length is determined based on a number of rotations and a rotation speed of a measuring wheel that is in direct contact with the film-like media.

9. The method of claim 8, wherein the tension of the film-like media increases with an increase in the brake force applied to the first shaft.

10. The method of claim 8, wherein the third shaft is in contact with the film-like media at the first position and the third shaft is not in contact with the film-like media at the second position.

11. The method of claim 8, wherein the adjustment of the third shaft between the first position and the second position is controlled by a retraction motor, the retraction motor coupled to the third shaft.

12. The method of claim 8, wherein rewinding of the film-like media onto the second roller includes adjusting the second speed of the second shaft based on a desired winding speed, the desired winding speed based on a type of the rolled-film like media.

13. The method of claim 12, wherein rewinding of the film-like media onto the second roller further includes adjusting the first speed of the first shaft based on the second speed of the second shaft.

14. The method of claim 8, further comprising, during said transporting of the rolled film-like media, adjusting the third shaft to a third speed, the third speed based on a desired winding speed, the desired winding speed based on a type of the rolled-film like media.

15. The method of claim 14, further comprising, during said rewinding, adjusting the third shaft to a fourth speed, the fourth speed less than the third speed.

16. The method of claim 15, wherein the fourth speed is zero revolutions per minute.

17. The method of claim 8, further comprising, upon completing the rewinding and during a cutting operation of the film-like media to separate the second roller from the first roller, adjusting the rolled film-like media to a desired cutting position and a desired cutting tension by adjusting the first speed of the first shaft, the second speed of the second shaft, and the brake force.

18. The method of claim 17, further comprising, upon completing the rewinding and during the cutting operation of the film-like media, maintaining the third shaft at the first position.

* * * * *